US011246429B2

(12) United States Patent
Yamashita et al.

(10) Patent No.: US 11,246,429 B2
(45) Date of Patent: Feb. 15, 2022

(54) IMAGE DISPLAY DEVICE AND FURNITURE INCLUDING THE IMAGE DISPLAY DEVICE

(71) Applicant: PANASONIC INTELLECTUAL PROPERTY MANAGEMENT CO., LTD., Osaka (JP)

(72) Inventors: Shuji Yamashita, Nara (JP); Jun Araya, Osaka (JP); Ichiro Okuda, Osaka (JP); Chiharu Matsukawa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/970,819

(22) PCT Filed: Oct. 31, 2019

(86) PCT No.: PCT/JP2019/042735
§ 371 (c)(1),
(2) Date: Aug. 18, 2020

(87) PCT Pub. No.: WO2020/202622
PCT Pub. Date: Oct. 8, 2020

(65) Prior Publication Data

US 2021/0235893 A1 Aug. 5, 2021

(30) Foreign Application Priority Data

Apr. 2, 2019 (JP) ..... JP2019-070889

(51) Int. Cl.
*A47F 11/10* (2006.01)
*G09F 13/04* (2006.01)

(52) U.S. Cl.
CPC ..... *A47F 11/10* (2013.01); *G09F 13/0413* (2013.01)

(58) Field of Classification Search
CPC ..... A47F 11/10; G09F 13/0413
See application file for complete search history.

(56) References Cited

U.S. PATENT DOCUMENTS

2010/0201908 A1 8/2010 Ishida
2018/0025679 A1 1/2018 Park et al.
2018/0061283 A1 3/2018 Kim et al.

FOREIGN PATENT DOCUMENTS

JP 2003-125904 A 5/2003
JP 2003-297128 A 10/2003
(Continued)

OTHER PUBLICATIONS

International Search Report and Written Opinion dated Jan. 28, 2020 in International Application No. PCT/JP2019/042735.

*Primary Examiner* — Thomas M Sember
(74) *Attorney, Agent, or Firm* — McDermott Will and Emery LLP

(57) ABSTRACT

An image display device according to the present embodiment includes: a display panel; a power line; and an outer frame. The display panel is switchable between an image display mode in which an image is displayed and a transmissive mode in which the display panel is in a transmissive state where an object behind the display panel is visible in a front view of the display panel. The power line is disposed along a periphery of the display panel. The outer frame is disposed along an edge of the display panel, and includes a first housing space for housing the power line and a second housing space for housing the edge of the display panel.

14 Claims, 19 Drawing Sheets

(56) References Cited

FOREIGN PATENT DOCUMENTS

| | | | |
|---|---|---|---|
| JP | 2010-211185 | A | 9/2010 |
| JP | 2011-209334 | A | 10/2011 |
| JP | 2015-022059 | A | 2/2015 |
| JP | 2017-513069 | A | 5/2017 |

IMAGE DISPLAY DEVICE AND FURNITURE INCLUDING THE IMAGE DISPLAY DEVICE

CROSS-REFERENCE OF RELATED APPLICATIONS

This application is the U.S. National Phase under 35 U.S.C. § 371 of International Patent Application No PCT/JP2019/042735, filed on Oct. 31, 2019, which in turn claims the benefit of Japanese Application No. 2019-070889, filed on Apr. 2, 2019, the entire disclosures of which Applications are incorporated by reference herein.

TECHNICAL FIELD

The present disclosure relates to an image display device operable in a transmissive mode and furniture including the image display device.

BACKGROUND ART

Patent Literature (PTL) 1 discloses a showcase with a transparent display and a display function. The transparent display is capable of displaying advertising information related to commercial products. By advertising with use of the transparent display in this way, a buyer of a product is capable of viewing the product and advertisement in a superimposed manner.

CITATION LIST

Patent Literature

[PTL 1] Japanese Unexamined Patent Application Publication No. 2003-125904

SUMMARY OF INVENTION

Technical Problem

The present disclosure provides an image display device which can be manufactured efficiently, and furniture including the image display device.

Solution to Problem

An image display device according to the present disclosure includes: a display panel switchable between an image display mode and a transmissive mode, the image display mode being a mode in which an image is displayed, the transmissive mode being a mode in which the display panel is in a transmissive state where an object behind the display panel is visible in a front view of the display panel; a power line disposed along a periphery of the display panel; and an outer frame disposed along an edge of the display panel, the outer frame including a first housing space for housing the power line and a second housing space for housing the edge of the display panel.

Advantageous Effects of Invention

According to the present disclosure, it is possible to provide an image display device which can be manufactured efficiently and furniture including the image display device.

DESCRIPTION OF EMBODIMENTS

Figure 1:
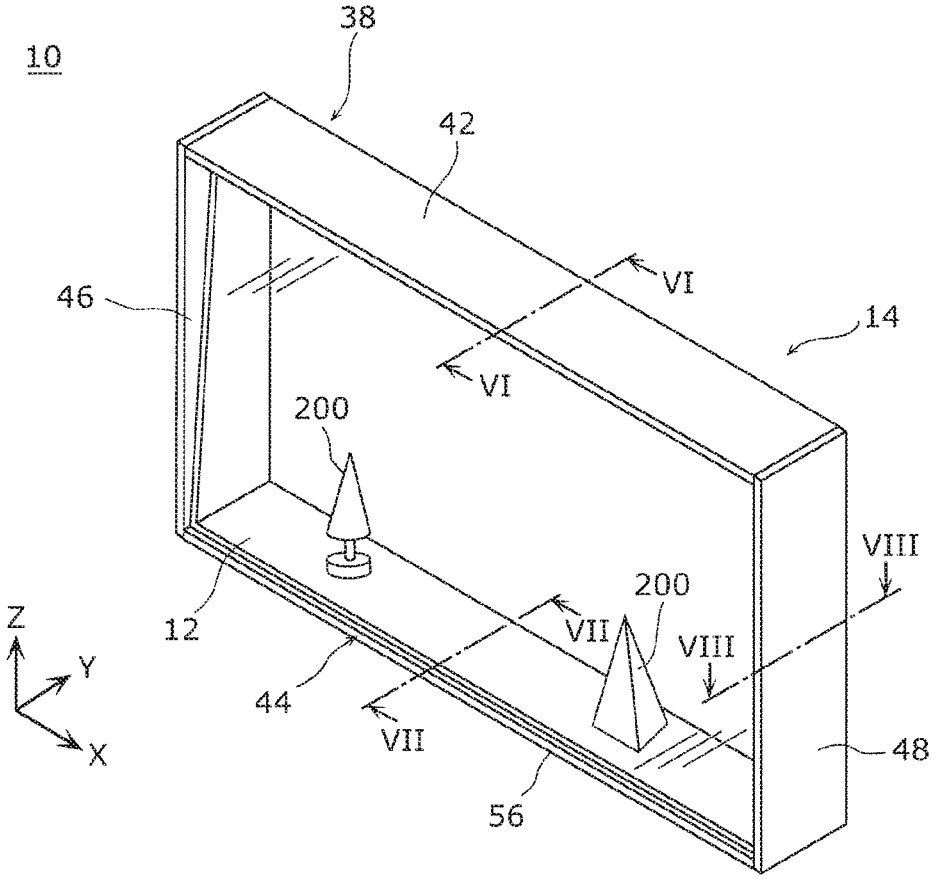
FIG. 1 is an external perspective view of a state of an image display device according to Embodiment 1 when operating in a first transmissive mode.

The inventors of the present application have found the following problem in a conventional showcase with a display function. In the conventional showcase with a display function, a transparent display and a drive circuit which drives the transparent display are electrically connected to each other by a flexible tape which is disposed inside a frame. The flexible tape disposed in such a manner may possibly be broken by, for example, contacting the edge of the transparent display at the time of manufacturing of the showcase with the display function. In the case where the flexible tape is broken, the transparent display and the drive circuit need to be reconnected to each other by using a new flexible tape, which leads to a reduced manufacturing efficiency.

The present disclosure has been conceived based on such finding. As a result of intensive studies by the inventors of the present application, the inventors have arrived at an idea of a configuration of an image display device which can be manufactured efficiently.

Hereinafter, embodiments will be described with reference to the drawings, as necessary. Note that unnecessarily detailed descriptions may be omitted. For example, detailed descriptions of already known matters and overlapping description of substantially the same configuration may be omitted. This is to avoid the following description to become unnecessarily redundant, and to facilitate understanding of the person skilled in the art. Note that the drawings are not necessarily precise illustrations.

The inventors of the present application provide the accompanying drawings and the following description so that the person skilled in the art fully understands the present disclosure, and do not intend to limit the subject matter of the claims by this.

Moreover, in the following embodiments, the vertical (top-bottom) direction is represented by a Z-axis, the front-back direction is represented by a Y-axis, and the horizontal (left-right) direction is represented by an X-axis for the sake of description, but these do not limit the orientation of the image display device according to the present disclosure at the time of manufacture or usage. Additionally, in the following descriptions, for example, a positive X-axis indicates the direction of the arrow of the X-axis and a negative X-axis indicates the direction opposite to the positive X-axis. The same applies to the Y-axis and the Z-axis.

Moreover, in the following embodiments, language such as parallel or perpendicular may be used to indicate the relative orientation of two directions, but this includes cases where the orientation is not as exactly stated. For example, "two directions are parallel" includes, in addition to exactly parallel, substantially parallel, that is to say, for example, includes a margin of error of about a few percent, unless otherwise noted.

Embodiment 1

Hereinafter, Embodiment 1 will be described with reference to the drawings.

[Configuration of Image Display Device]

Figure 2:
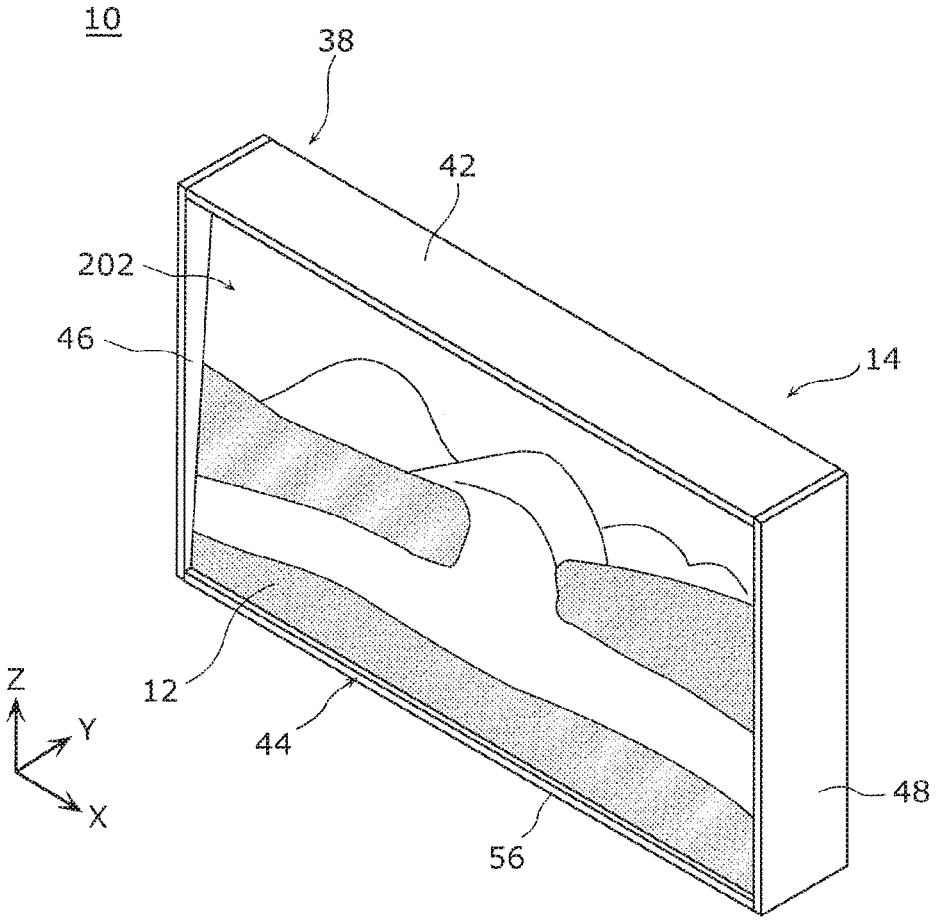
FIG. 2 is an external perspective view of a state of the image display device according to Embodiment 1 when operating in an image display mode.
Figure 3:
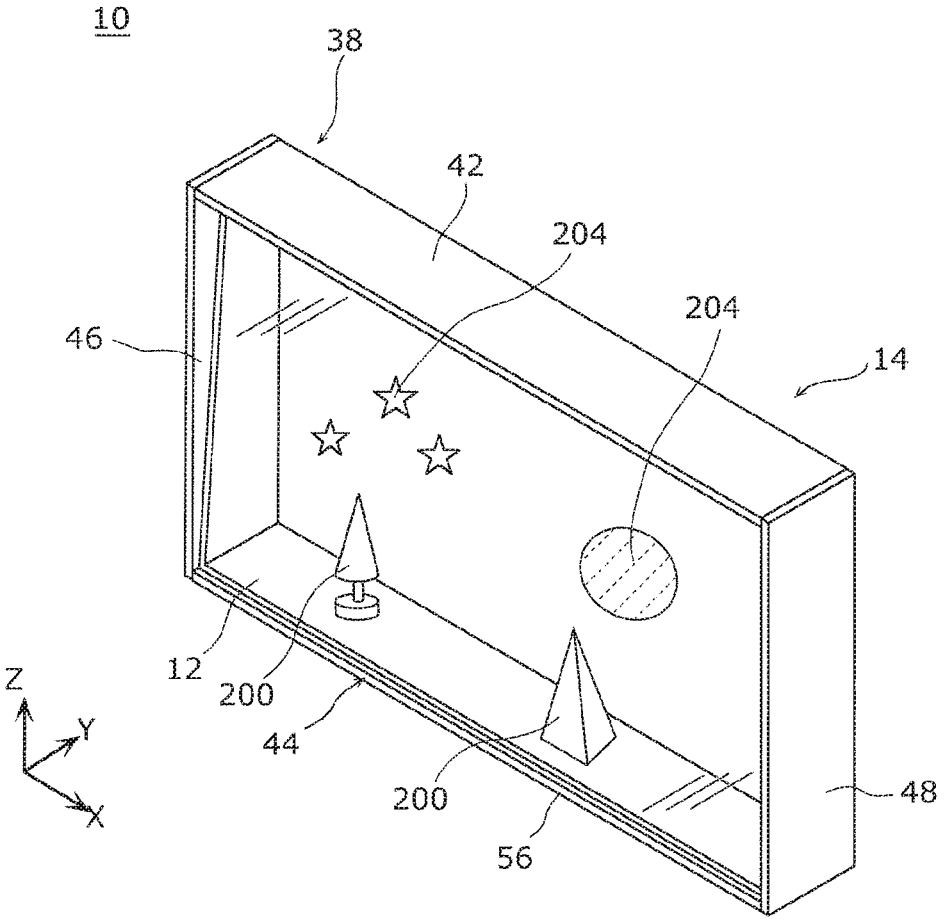
FIG. 3 is an external perspective view of a state of the image display device according to Embodiment 1 when operating in a second transmissive mode.
Figure 4:
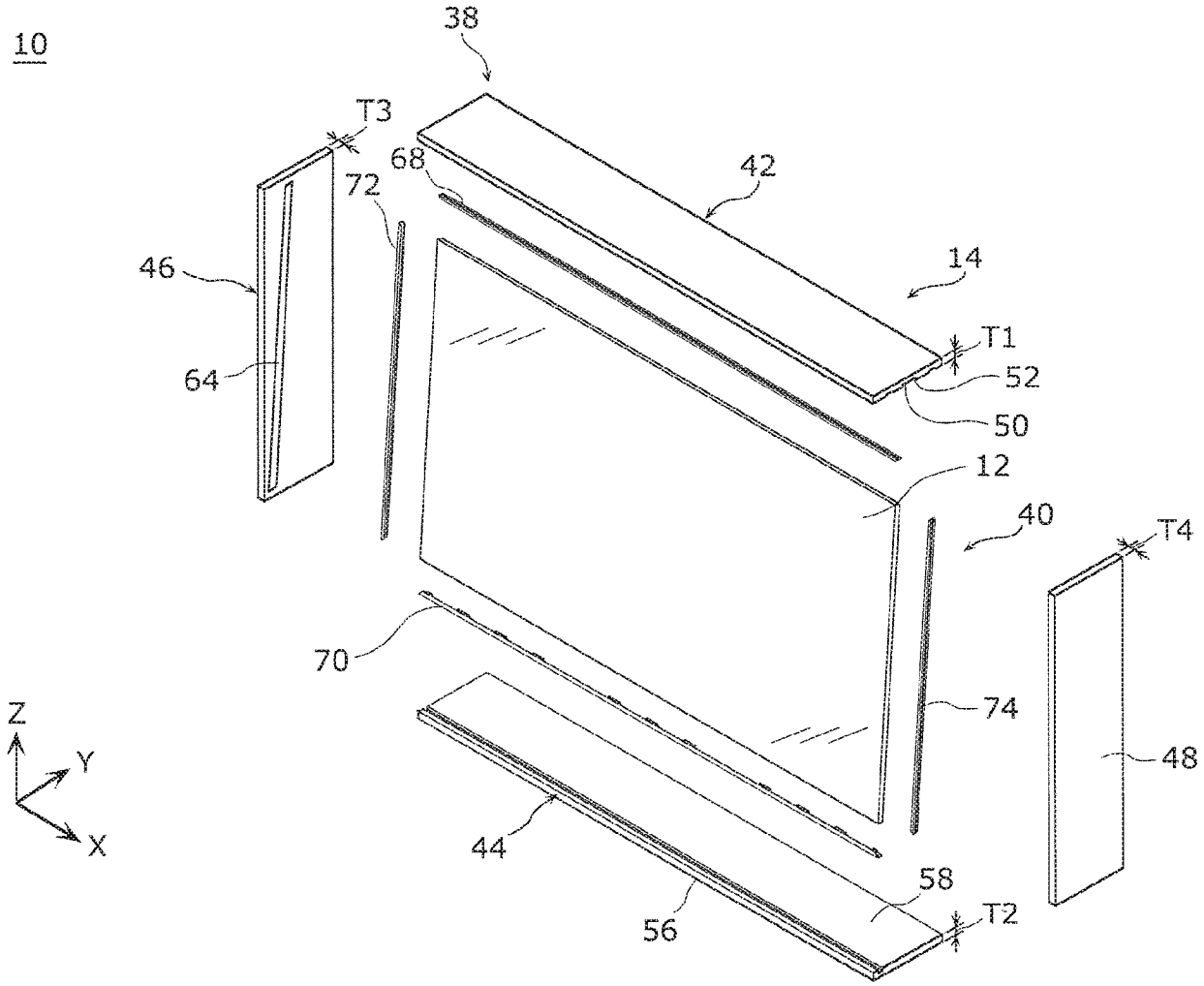
FIG. 4 is an exploded perspective view of a state of the image display device according to Embodiment 1 when operating in the first transmissive mode.
Figure 5:
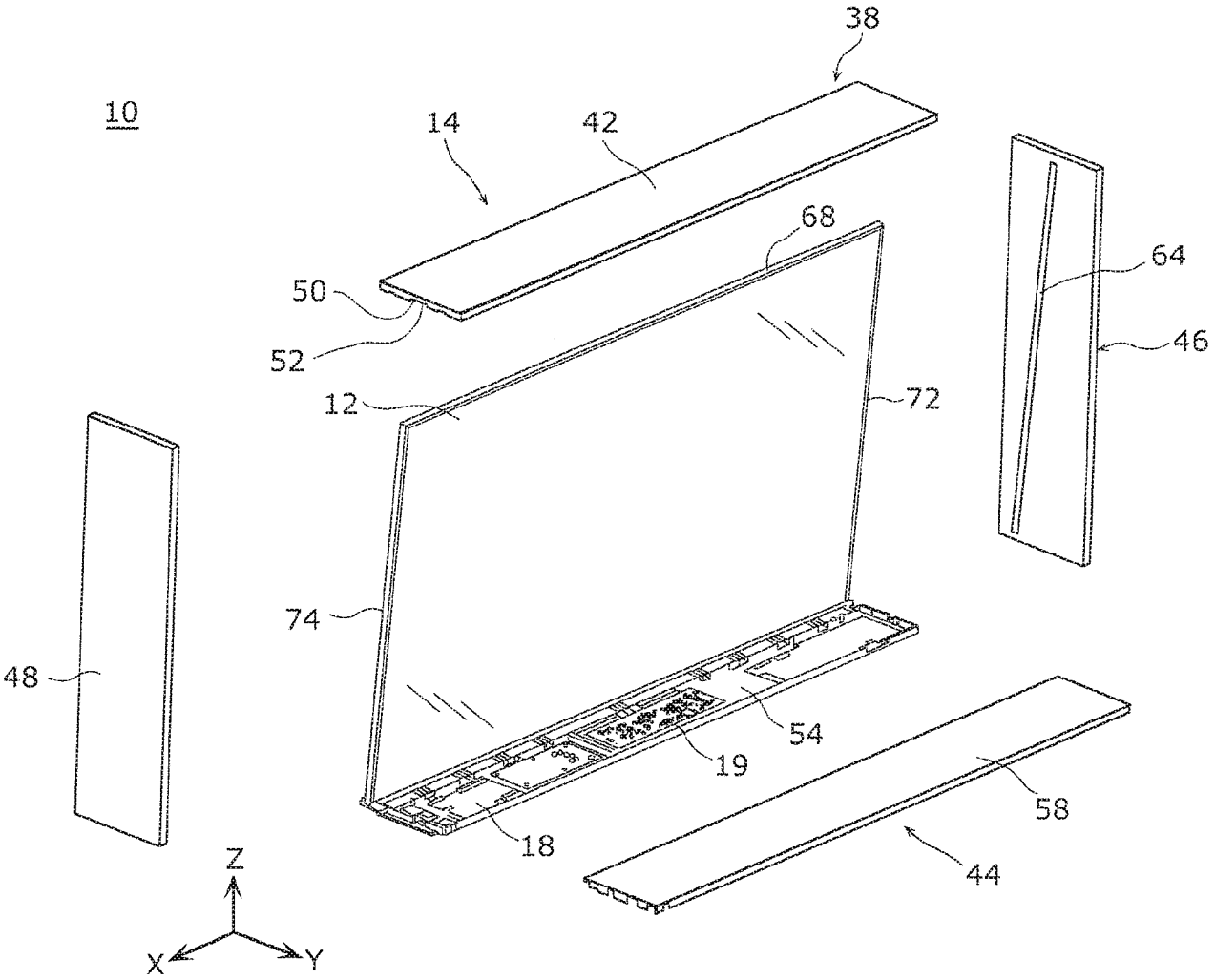
FIG. 5 is a rearward exploded perspective view of a state of the image display device according to Embodiment 1 when operating in the first transmissive mode.
Figure 6:
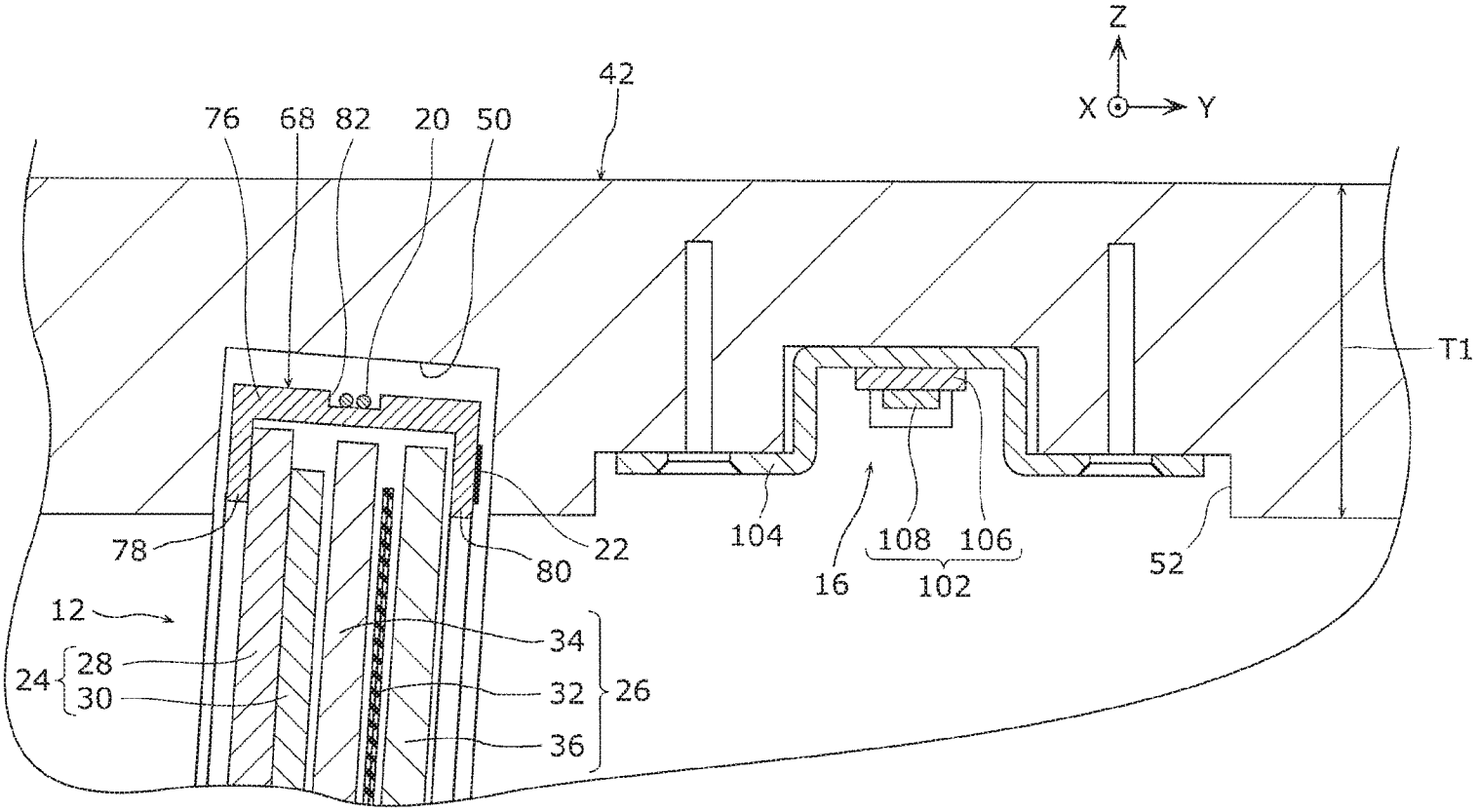
FIG. 6 is a cross-sectional view taken along line VI-VI in FIG. 1.

FIG. 1 is an external perspective view of a state of image display device 10 according to Embodiment 1 when operating in a first transmissive mode. FIG. 2 is an external perspective view of image display device 10 according to Embodiment 1 when operating in an image display mode. FIG. 3 is an external perspective view of image display device 10 according to Embodiment 1 when operating in a second transmissive mode. FIG. 4 is an exploded perspective view of a state of image display device 10 according to Embodiment 1 when operating in the first transmissive mode. FIG. 5 is a rearward exploded perspective view of a state of image display device 10 according to Embodiment 1 when operating in the first transmissive mode. FIG. 6 is a cross-sectional view taken along line VI-VI in FIG. 1.

As illustrated in FIG. 1, FIG. 4, FIG. 5, and FIG. 6, image display device 10 according to the present embodiment includes display panel 12, frame unit 14, illumination unit 16, power supply unit 18, panel controller 19, power lines 20, and conductive component 22.

(Display Panel)

As illustrated in FIG. 1 to FIG. 3, display panel 12 is a display device switchable between an image display mode in which an image is displayed and a transmissive mode in which display panel 12 is in a transmissive state where each of objects behind display panel 12 is visible in the front view of display panel 12. Display panel 12 has a rectangular shape in the front view. Specifically, as illustrated in FIG. 6, display panel 12 includes organic electro-luminescent (EL) panel 24 and light control panel 26 disposed behind organic EL panel 24. Note that the "image" displayed on display panel 12 may be any of a still image or a moving image, or may be video content including both the still image and the moving image.

Organic EL panel 24 includes front glass plate 28, and organic light-emitting diode (OLED) panel 30 disposed behind front glass plate 28. In the present embodiment, organic EL elements, each of which includes an EL layer and transparent electrodes sandwiching the EL layer, are disposed in a matrix in OLED panel 30. The region of OLED panel 30 where an image (including background image) is not displayed has light transmitting properties to the extent generally referred to as transparent.

Light control panel 26 includes light control sheet 32, first glass plate 34 disposed in front of light control sheet 32, and second glass plate 36 disposed behind light control sheet 32. Light control sheet 32 is a component switchable between a light transmissive state and a light non-transmissive state depending on whether or not a predetermined voltage is applied to light control sheet 32. Light control sheet 32 includes, for example, a liquid crystal layer including liquid crystal molecules having an orientational state changed by presence or absence of an application of voltage, and resin sheets sandwiching the liquid crystal layer.

Display panel 12 configured such that organic EL panel 24 and light control panel 26 are layered, becomes, for example, as illustrated in FIG. 1, a first transmissive mode, in which objects 200 behind display panel 12 are visible, by not displaying an image on organic EL panel 24 and applying a predetermined voltage to light control sheet 32 (turning on light control sheet 32). As illustrated in FIG. 2, display panel 12 becomes an image display mode by displaying image 202 on the entire region of the image display region of organic EL panel 24 and not applying a predetermined voltage to light control sheet 32 (turning off light control sheet 32). Moreover, as illustrated in FIG. 3, display panel 12 becomes a second transmissive mode in which objects 200 behind display panel 12 are visible while partial images 204 are displayed by displaying partial images 204 in a portion of the image display region of organic EL panel 24 and turning on light control sheet 32 (making light control sheet 32 transmissive). In the present embodiment, each of the first transmissive mode and the second transmissive mode correspond to a transmissive mode. Moreover, display panel 12 may include, for example, an optical component, such as an anti-reflection film, in addition to the above described structural elements.

(Frame Unit)

As illustrated in FIG. 4 and FIG. 5, frame unit 14 is a component disposed along the edge of display panel 12, and includes outer frame 38, and inner frame 40 which is separated from outer frame 38.

Outer frame 38 is a component which supports display panel 12. Outer frame 38 includes upper plate 42 disposed along the upper edge of display panel 12, lower plate 44 disposed along the lower edge of display panel 12, left plate 46 disposed along the left edge of display panel 12, and right plate 48 disposed along the right edge of display panel 12. Outer frame 38 supports display panel 12 such that display panel 12 tilts slightly rearward. Each of upper plate 42, lower plate 44, left plate 46, and right plate 48 has a plate shape. Each of upper plate 42, lower plate 44, left plate 46, and right plate 48 protrudes forward and rearward relative to display panel 12. Upper plate 42 and lower plate 44 are disposed parallel to each other, and left plate 46 and right plate 48 are disposed parallel to each other.

As illustrated in FIG. 4 and FIG. 6, upper plate 42 includes first top groove 50 and second top groove 52 which are disposed on the bottom surface of upper plate 42. First top groove 50 and second top groove 52 are formed within the thickness of upper plate 42. Specifically, first top groove 50 and second top groove 52 are positioned within thickness T1 (see FIG. 4 and FIG. 6) of upper plate 42 in the vertical direction.

First top groove 50 is a groove for housing the upper edge of display panel 12, upper molding portion 68 (to be described later) attached to the upper edge of display panel 12, and power line 20 housed in grooves 82 and 84 (to be described later) of upper molding portion 68. First top groove 50 is disposed along the upper edge of display panel 12. First top groove 50 is recessed upward and extends in the horizontal direction. First top groove 50 ranges from the left edge to the right edge of upper plate 42.

Upper plate 42 houses, within thickness T1 of upper plate 42, the upper edge of display panel 12, upper molding portion 68 attached to the upper edge of display panel 12, and power line 20 housed in grooves 82 and 84 of upper molding portion 68, by housing, in the space within first top groove 50, the upper edge of display panel 12, upper molding portion 68 attached to the upper edge of display panel 12, and power line 20 housed in grooves 82 and 84 of upper molding portion 68. As described above, upper plate 42 includes, within thickness T1 of upper plate 42, a first housing space for housing power line 20 and a second housing space for housing the upper edge of display panel 12. The first housing space and the second housing space are spaces in first top groove 50.

Second top groove 52 is a groove for housing illumination unit 16. Second top groove 52 is recessed upward behind first top groove 50, and extends in the horizontal direction. Second top groove 52 ranges from the left edge to the right edge of upper plate 42. Upper plate 42 houses illumination unit 16 within thickness T1 of upper plate 42 by housing illumination unit 16 in the space within second top groove 52.

Figure 7:
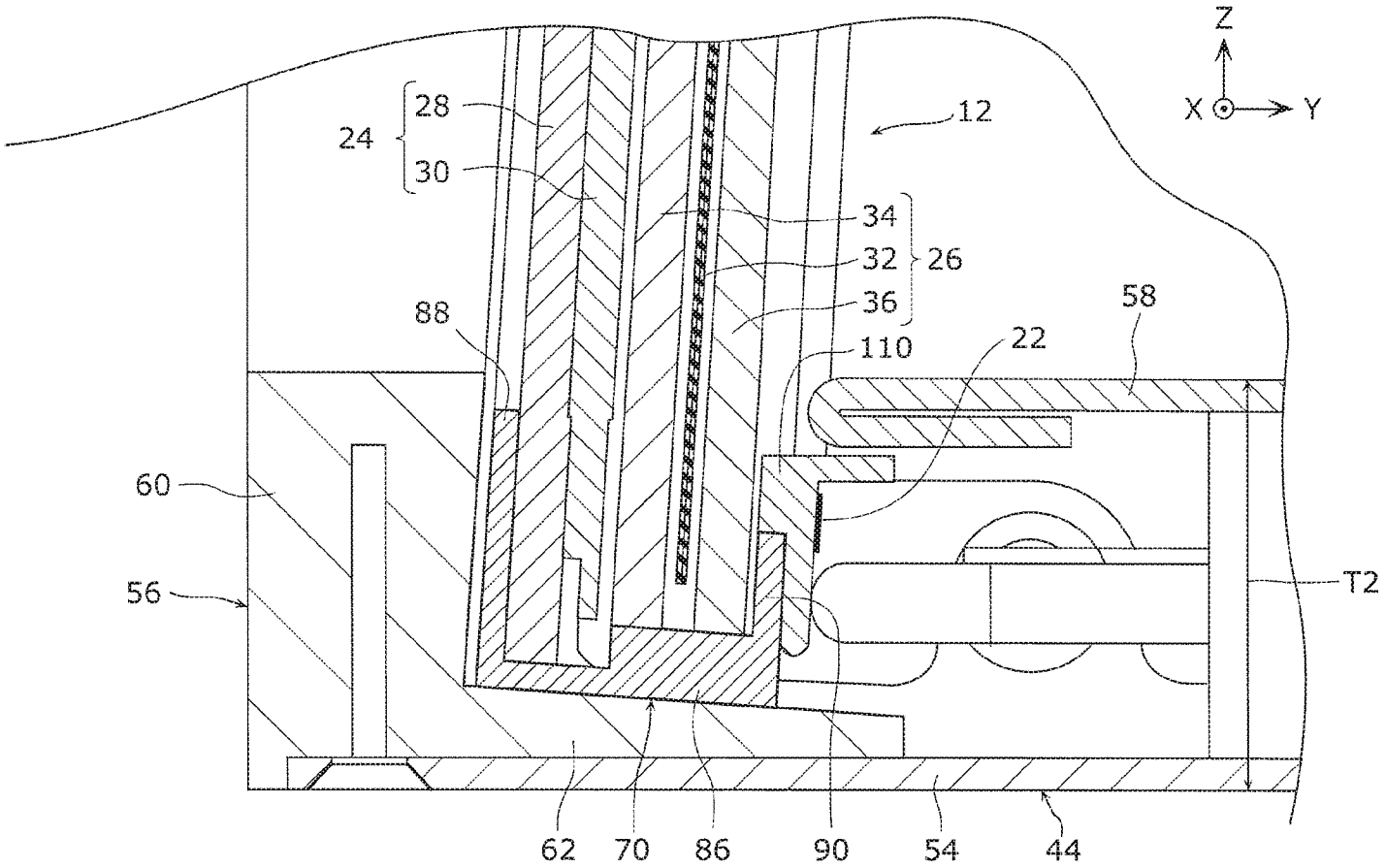
FIG. 7 is a cross-sectional view taken along line VII-VII in FIG. 1.

FIG. 7 is a cross-sectional view taken along line VII-VII in FIG. 1. As illustrated in FIG. 4, FIG. 5, and FIG. 7, lower plate 44 includes bottom plate 54, front wall 56, and cover 58. Bottom plate 54 extends in the horizontal direction. On the top surface of bottom plate 54, power supply unit 18, panel controller 19, and the like are disposed. Front wall 56 is disposed along the front edge of bottom plate 54, and is fixed to bottom plate 54. Front portion 60 of front wall 56 protrudes upward relative to back portion 62. On the top surface of back portion 62 of front wall 56, lower molding portion 70 (to be described later) attached to the lower edge of display panel 12 is disposed. Cover 58 is disposed above bottom plate 54 so as to cover power supply unit 18, panel controller 19, and the like. The front edge of cover 58 is disposed so as to be spaced apart from front portion 60 of front wall 56 in the front and back direction.

Lower plate 44 houses the lower edge of display panel 12 and lower molding portion 70 attached to the lower edge of display panel 12 within thickness T2 (see FIG. 4 and FIG. 7) of lower plate 44 in the vertical direction, by inserting the lower edge of display panel 12 between front portion 60 of front wall 56 and the front edge of cover 58 and disposing lower molding portion 70 attached to the lower edge of display panel 12 on the top surface of back portion 62 of front wall 56. Objects 200 (photo, doll, vase, toy, model, picture or the like) can be placed on the top surface of cover 58. When display panel 12 operates in a transmissive mode, the user is capable of viewing objects 200 placed on the top surface of cover 58 via display panel 12. In this way, image display device 10 can be used as furniture on which various objects such as object 200 can be placed. The elements housed in lower plate 44 are not limited to power supply unit 18 and panel controller 19. For example, a loudspeaker device, an exhaust fan, a television tuner, an optical disk player and the like may be housed in lower plate 44.

As illustrated in FIG. 4, left plate 46 connects the left edge of upper plate 42 and the left edge of lower plate 44, and includes left groove 64 on the right-side surface of left plate 46. Left groove 64 is formed within the thickness of left plate 46. Specifically, left groove 64 is positioned within thickness T3 (see FIG. 4) of left plate 46 in the horizontal direction. Left groove 64 is a groove for housing the left edge of display panel 12, left molding portion 72 (to be described later) attached to the left edge of display panel 12, and power line 20 housed in the groove of left molding portion 72. Left groove 64 is disposed along the left edge of display panel 12. Left groove 64 is recessed toward the left, and diagonally extends in the vertical direction.

Left plate 46 houses, within thickness T3 of left plate 46, the left edge of display panel 12, left molding portion 72 attached to the left edge of display panel 12, and power line 20 housed in the groove of left molding portion 72 by housing, in the space within left groove 64, the left edge of display panel 12, left molding portion 72 attached to the left edge of display panel 12, and power line 20 housed in the groove of left molding portion 72. As described above, left plate 46 includes, within thickness T3 of left plate 46, a first housing space for housing power line 20 and a second housing space for housing the left edge of display panel 12. The first housing space and the second housing space are spaces within left groove 64.

Figure 8:
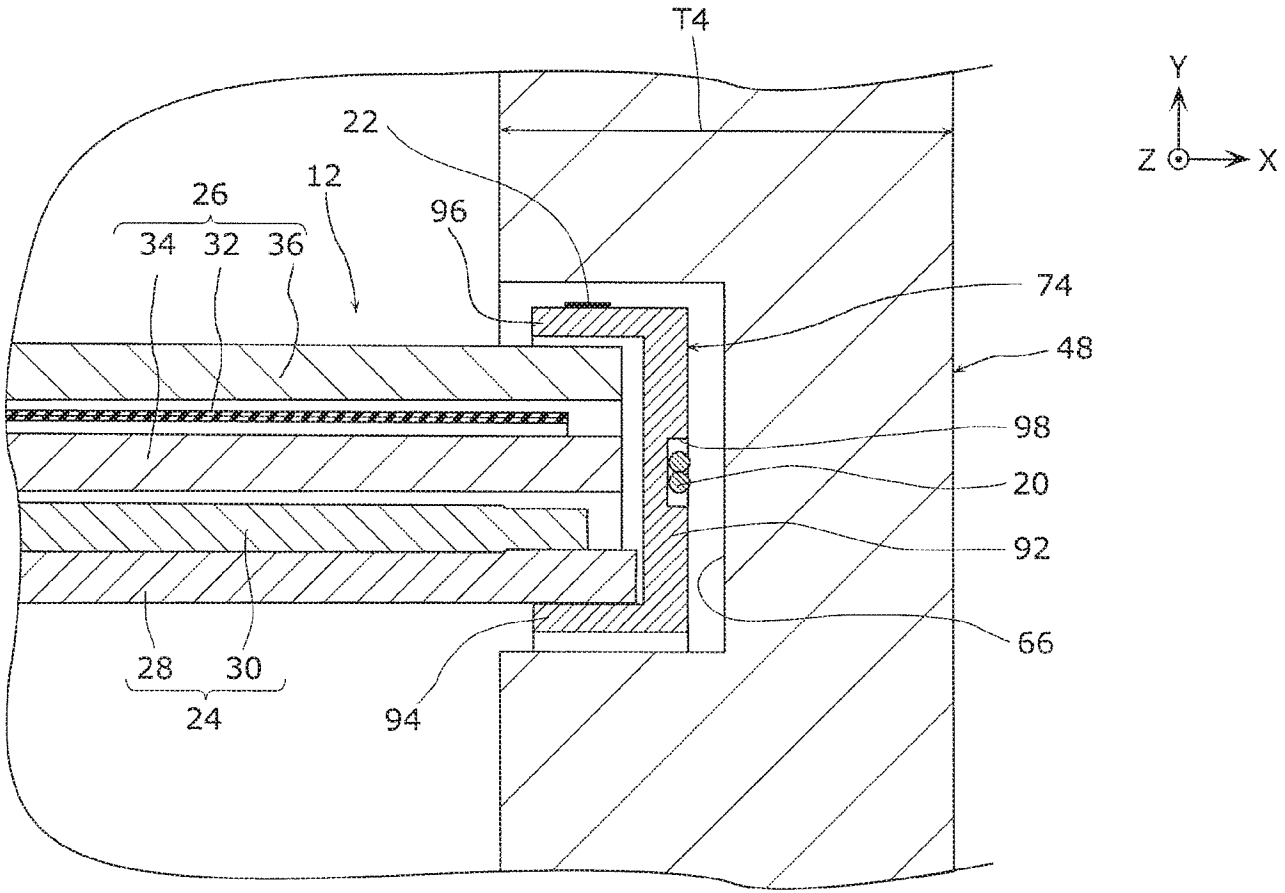
FIG. 8 is a cross-sectional view taken along line VIII-VIII FIG. 1.

FIG. 8 is a cross-sectional view taken along line VIII-VIII in FIG. 1. As illustrated in FIG. 4 and FIG. 8, right plate 48 connects the right edge of upper plate 42 and the right edge of lower plate 44, and includes right groove 66 on the left-side surface of right plate 48. Right plate 48 is disposed symmetrically relative to left plate 46. Right groove 66 is formed within the thickness of right plate 48. Specifically, right groove 66 is positioned within thickness T4 (see FIG. 4 and FIG. 8) of right plate 48 in the horizontal direction. Right groove 66 is a groove for housing the right edge of display panel 12, right molding portion 74 (to be described later) attached to the right edge of display panel 12, and power line 20 housed in grooves 98 and 100 (to be described later) of right molding portion 74. Right groove 66 is disposed along the right edge of display panel 12. Right groove 66 is recessed toward the right, and diagonally extends in the vertical direction.

Right plate 48 houses, within thickness T4 of right plate 48, the right edge of display panel 12, right molding portion 74 attached to the right edge of display panel 12, and power line 20 housed in grooves 98 and 100 of right molding portion 74 by housing, in the space within right groove 66, the right edge of display panel 12, right molding portion 74 attached to the right edge of display panel 12, and power line 20 housed in grooves 98 and 100 of right molding portion 74, As described above, right plate 48 includes, within thickness T4 of right plate 48, a first housing space for housing power line 20 and a second housing space for housing the right edge of display panel 12. The first housing space and the second housing space are spaces within right groove 66.

For the materials of upper plate 42, lower plate 44, left plate 46, and right plate 48, for example, wood can be used. With this, for example, when image display device 10 is used in a room where wooden furniture or the like is placed, loss of interior aesthetic can be prevented. In the present embodiment, upper plate 42 corresponds to an upper outer frame, and lower plate 44 corresponds to a lower outer frame. Moreover, in the present embodiment, each of first top groove 50, left groove 64, and right groove 66 corresponds to an outer frame groove.

As illustrated in FIG. 4, inner frame 40 is a component attached to the edge of display panel 12, Inner frame 40 includes upper molding portion 68 attached to the upper edge of display panel 12, lower molding portion 70 attached to the lower edge of display panel 12, left molding portion 72 attached to the left edge of display panel 12, and right molding portion 74 attached to the right edge of display panel 12.

As illustrated in FIG. 4 and FIG. 6, upper molding portion 68 is disposed along the upper edge of display panel 12. Upper molding portion 68 is a component which is opened downward and has a cross-section with a substantial U shape. Upper molding portion 68 is attached to the upper edge of display panel 12 so as to sandwich the upper edge of display panel 12. Upper molding portion 68 includes main body 76, front wall 78, back wall 80, and grooves 82 and 84. Main body 76 opposes the top end surface of display panel 12, and is elongated along the top end surface of display panel 12. Front wall 78 protrudes from one end of main body 76 in the width-wise direction toward display panel 12, and is disposed so as to oppose the front surface of front glass plate 28. Back wall 80 protrudes from the other end of main body 76 in the width-wise direction toward display panel 12, and is disposed so as to oppose the back surface of second glass plate 36. Upper molding portion 68 is disposed such that display panel 12 is sandwich between front wall 78 and back wall 80. Grooves 82 and 84 are grooves for housing power line 20 (see FIG. 10). Grooves 82 and 84 are disposed on a main surface of main body 76 opposite to the other main surface of main body 76 adjacent to the top end surface of display panel 12. Grooves 82 and 84 are recessed toward display panel 12. Groove 82 extends in the length-wise direction of main body 76, and ranges from one end to the other end of main body 76 in the length-wise direction. In other words, groove 82 is disposed along the top end surface of the upper edge of display panel 12. Groove 84 is disposed at a position slightly toward the center relative to one end of main body 76 in the length-wise direction, and at a position slightly toward the center relative to the other end of main body 76 in the length-wise direction. Groove 84 is in communication with groove 82, and extends rearward from groove 82. In a state where power line 20 is housed in grooves 82 and 84, upper molding portion 68 is positioned between power line 20 and display panel 12.

As illustrated in FIG. 4 and FIG. 7, lower molding portion 70 is disposed along the lower edge of display panel 12. Lower molding portion 70 is a component which is opened upward and has a cross-section with a substantial U shape. Lower molding portion 70 is attached to the lower edge of display panel 12 so as to sandwich the lower edge of display panel 12. Lower molding portion 70 includes main body 86, front wall 88, and back wall 90. Main body 86 opposes the bottom end surface of display panel 12, and is elongated along the bottom end surface of display panel 12. Front wall 88 protrudes from one end of main body 86 in the width-wise direction toward display panel 12, and is disposed so as to oppose the front surface of front glass plate 28. Back wall 90 protrudes from the other end of main body 86 in the width-wise direction toward display panel 12, and is disposed so as to oppose the back surface of second glass plate 36. Lower molding portion 70 is disposed such that display panel 12 is sandwiched between front wall 88 and back wall 90.

As illustrated in FIG. 4, left molding portion 72 is disposed along the left edge of display panel 12. Left molding portion 72 is a component which is opened toward the right and has a cross-section with a substantial U shape. Left molding portion 72 is attached to the left edge of display panel 12 so as to sandwich the left edge of display panel 12. Left molding portion 72 is disposed symmetrically relative to right molding portion 74. Hence, detailed description of left molding portion 72 will be omitted by referring to the description of right molding portion 74 to be described later.

As illustrated in FIG. 4 and FIG. 8, right molding portion 74 is disposed along the right edge of display panel 12. Right molding portion 74 is a component which is opened toward the left, and has a cross-section with a substantial U shape. Right molding portion 74 is attached to the right edge of display panel 12 so as to sandwich the right edge of display panel 12. Right molding portion 74 includes main body 92, front wall 94, back wall 96, and grooves 98 and 100. Main body 92 opposes the right end surface of display panel 12, and is elongated along the right end surface of display panel 12. Front wall 94 protrudes from one end of main body 92 in the width-wise direction toward display panel 12, and is disposed so as to oppose the front surface of front glass plate 28. Back wall 96 protrudes from the other end of main body 92 in the width-wise direction toward display panel 12, and is disposed so as to oppose the back surface of second glass plate 36. Right molding portion 74 is disposed such that display panel 12 is sandwiched between front wall 94 and back wall 96. Grooves 98 and 100 are grooves for housing power line 20 (see FIG. 9 and FIG. 10). Grooves 98 and 100 are disposed on a main surface of main body 92 opposite to the other main surface of main body 92 adjacent to the right end surface of display panel 12. Grooves 98 and 100 are recessed toward display panel 12. Groove 98 extends in the length-wise direction of main body 92, and ranges from one end to the other end of main body 92 in the length-wise direction. In other words, groove 98 is disposed along the right end surface of the right edge of display panel 12. Grooves 100 are disposed on one end and the other end of main body 92 in the length-wise direction. Grooves 100 are in communication with groove 98, and extend rearward from groove 98. In a state where power line 20 is housed in grooves 98 and 100, right molding portion 74 is positioned between power line 20 and display panel 12.

Each of molding portions 68, 70, 72, and 74 is attached to the edge of display panel 12 by, for example, an adhesive tape. In the present embodiment, each of molding portions 68, 70, 72, and 74 is made of a material having a flexibility greater than the flexibility of upper plate 42, lower plate 44, left plate 46 and right plate 48. For materials of molding portions 68, 70, 72, and 74, for example, ABS resin can be used. Another examples of the materials for molding portions 68, 70, 72, and 74 include thermoplastic resin and elastomer based resin. By using flexible materials for molding portions 68, 70, 72, and 74, it is possible to prevent molding portions 68, 70, 72, and 74 and/or display panel 12 from being broken due to contact between molding portions 68, 70, 72, and 74 and display panel 12. Moreover, in the present embodiment, front wall 78 and back wall 80 correspond to a pair of walls. In a similar manner, front wall 88 and back wall 90 correspond to the pair of walls, and front wall 94 and back wall 96 correspond to the pair of walls.

Moreover, in the present embodiment, each of groove 82, groove 84, groove 98, and groove 100 corresponds to an inner frame groove.

(Illumination Unit)

As illustrated in FIG. 6, illumination unit 16 is disposed in second top groove 52, on the bottom surface of upper plate 42, and is supported by upper plate 42. As described above, minute light shielding elements, such as organic EL elements and liquid crystals, are dispersed in display panel 12. Hence, even when display panel 12 operates in the transmissive mode, the light transmittance of display panel 12 is, for example, 40% to 50% approximately. Accordingly, for example, when image display device 10 is placed in a relatively dark environment, the user may fail to clearly view objects 200 placed behind display panel 12. However, objects 200 placed behind (on the back side of) display panel 12 can be illuminated with the light emitted from illumination unit 16.

Illumination unit 16 includes light source unit 102 which emits light and support 104 for attaching light source unit 102 to the bottom surface of upper plate 42. Illumination unit 16 is embedded in second top groove 52. Accordingly, when display panel 12 is turned into a transmissive state, it is possible to prevent the light emitted from illumination unit 16 from directly entering the eyes of the user in front of image display device 10. Light source unit 102 includes substrate 106 elongated in the horizontal direction and a plurality of LED elements 108 mounted on substrate 106. One or more objects 200 placed on lower plate 44 are illuminated by illumination unit 16 configured as above.

(Power Supply Unit)

As illustrated in FIG. 5, power supply unit 18 is housed inside lower plate 44, and is supported by lower plate 44. Power supply unit 18 supplies power to, for example, display panel 12, illumination unit 16, and panel controller 19. Power supply unit 18 includes, for example, one or more circuit boards and a plurality of electronic components mounted on the one or more circuit boards. Power supply unit 18 is disposed along bottom plate 54, such that power supply unit 18 is housed within thickness T2 (width in the Z-axis direction) of lower plate 44.

(Panel Controller)

As illustrated in FIG. 5, panel controller 19 is housed inside lower plate 44. Panel controller 19 forms a so-called timing controller. Panel controller 19 generates various types of signals, such as a clock signal for distributing image data to be displayed on display panel 12 to each pixel included in display panel 12, and supplies the signals to display panel 12. Panel controller 19 is disposed along bottom plate 54, such that panel controller 19 is housed within thickness T2 (width in the Z-axis direction) of lower plate 44.

(Power Line)

Figure 9:
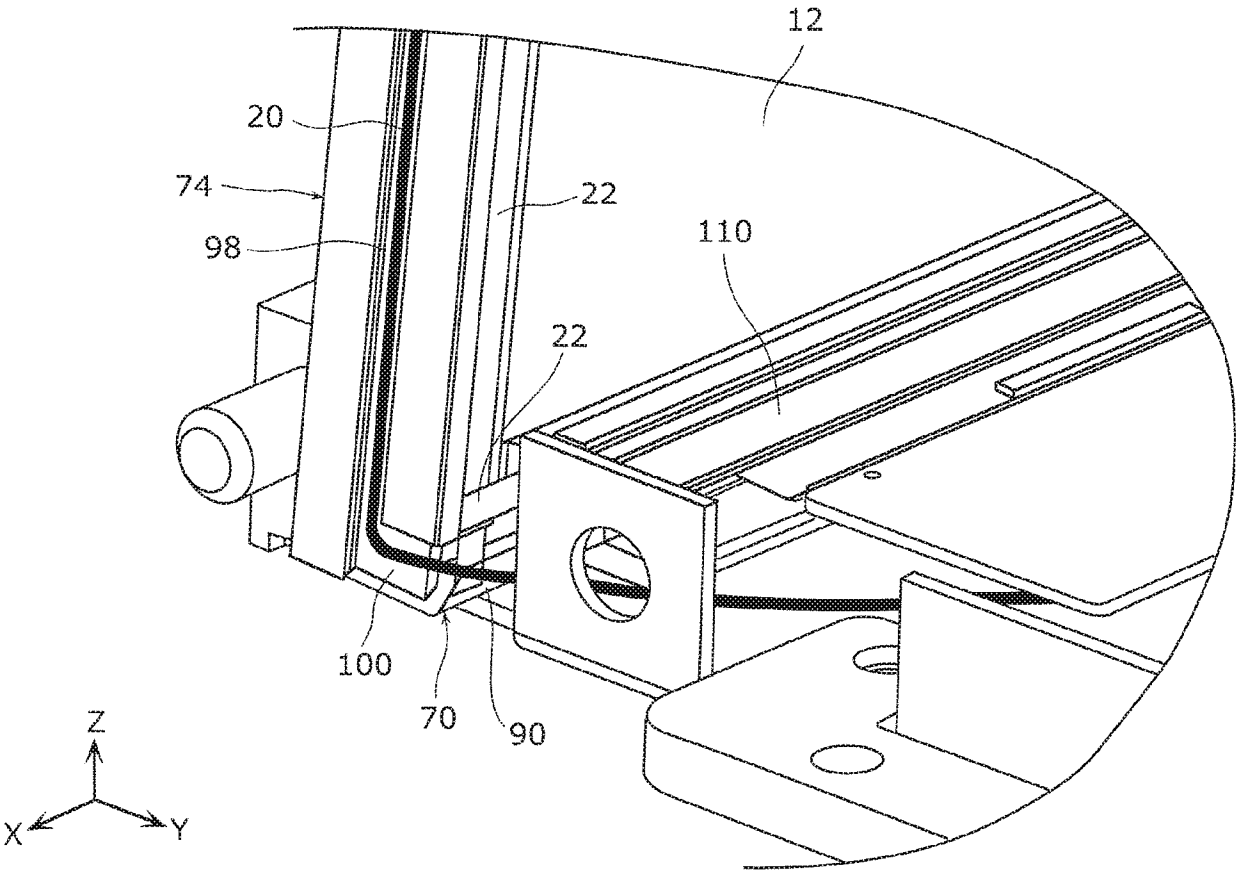
FIG. 9 is an enlarged view of a lower molding portion and a right molding portion.
Figure 10:
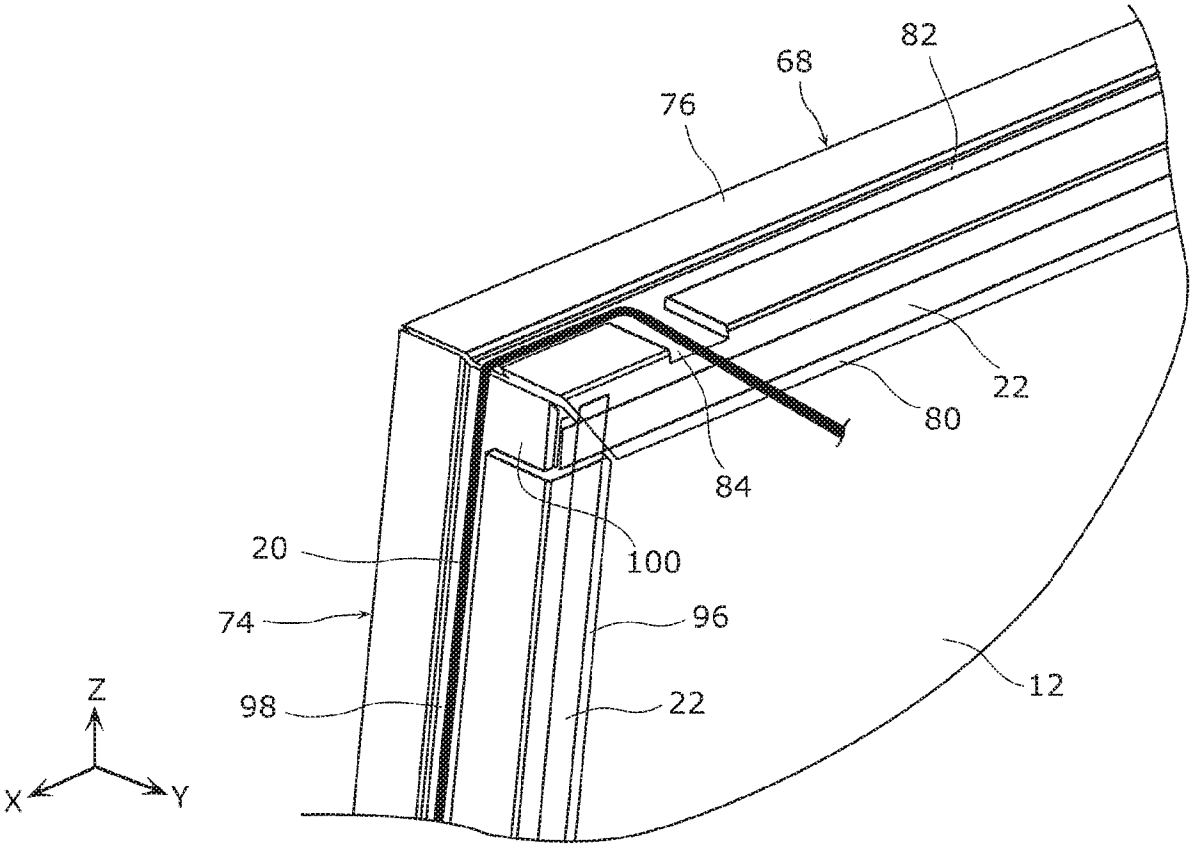
FIG. 10 is an enlarged view of an upper molding portion and the right molding portion.

FIG. 9 is an enlarged view of lower molding portion 70 and right molding portion 74. FIG. 10 is an enlarged view of upper molding portion 68 and right molding portion 74. With reference to FIG. 9 and FIG. 10, in the present embodiment, power line 20 is a power line which electrically connects illumination unit 16 and power supply unit 18. Power line 20 is disposed along the periphery of display panel 12. Power line 20 connected to power supply unit 18 in lower plate 44, for example, extends upward along the end surface of display panel 12, and is connected to illumination unit 16. Specifically, for example, with reference to FIG. 9, power line 20 connected to power supply unit 18 is led to groove 98 via groove 100 of right molding portion 74, and is led upward along groove 98. With reference to FIG. 10, power line 20 is led to groove 82 of upper molding portion 68 from groove 98 of right molding portion 74, and is connected to illumination unit 16 via groove 84 of upper molding portion 68. In this way, power line 20 extends upward along the right edge of display panel 12, so that power supply unit 18 and illumination unit 16 can be electrically connected. Power line 20 may be connected to illumination unit 16 via groove 100 of right molding portion 74. The wiring route of power line 20 is not limited to the above example. For example, power line 20 may extend along the left edge of display panel 12, or extend along the upper edge of display panel 12 (see FIG. 6). Moreover, the number of power lines housed in grooves 82, 84, 98, and 100 may be one or plural. The cross-sectional shape of the power line is not limited to a circular shape, but may be a square shape or the like. Moreover, it may be that the diameter of the power line is greater than the depth of each of grooves 82, 84, 98, and 100, and that the power line is housed in grooves 82, 84, 98, and 100 while part of the power line is protruding from the grooves. For power line 20, for example, a power line is used in which a conductor, such as a copper line, is covered by an insulator.

(Conductive Component)

As illustrated in FIG. 9 and FIG. 10, conductive component 22 is disposed on each of the back surface of back wall 80 of upper molding portion 68, on the back surface of the back wall of left molding portion 72, and on the back surface of back wall 96 of right molding portion 74. Conductive component 22 is also disposed on the back surface of cover 110 attached to back wall 90 of lower molding portion 70 (see FIG. 5). Accordingly, it is possible to prevent electrification of image display device 10. For conductive component 22, for example, a conductive tape or a conductive filler can be used.

[Advantageous Effects, etc.]

As described above, image display device 10 according to the present embodiment includes display panel 12, power line 20, and outer frame 38. Display panel 12 is switchable between an image display mode in which an image is displayed and a transmissive mode in which display panel 12 is in a transmissive state where objects 200 behind display panel 12 are visible in the front view. Power line 20 is disposed along the periphery of display panel 12. Outer frame 38 is disposed along the edge of display panel 12, and includes a first housing space for housing power line 20 and a second housing space for housing the edge of display panel 12.

With this configuration, outer frame 38 includes the first housing space for housing power line 20 and the second housing space for housing the edge of display panel 12. Accordingly, power line 20 and the edge of display panel 12 can be easily housed in outer frame 38. Hence, image display device 10 can be manufactured efficiently. Since power line 20 is housed in outer frame 38, it is possible to prevent power line 20 from being seen by the user.

Moreover, in image display device 10 according to the present embodiment, outer frame 38 (upper plate 42, left plate 46, and right plate 48) includes outer frame grooves (first top groove 50, left groove 64, and right groove 66) within the thickness of outer frame 38. The first housing space and the second housing space are spaces within the outer frame grooves (first top groove 50, left groove 64, and right groove 66).

With this configuration, the first housing space for housing power line 20 and the second housing space for housing the edge of display panel 12 are spaces within the outer frame grooves (first top groove 50, left groove 64, and right groove 66) within the thickness of outer frame 38 (upper plate 42, left plate 46, and right plate 48). Hence, by housing power line 20 and the edge of display panel 12 in the outer frame groove (first top groove 50, left groove 64, and right groove 66), power line 20 and the edge of display panel 12 can be easily housed within the thickness of outer frame 38 (upper plate 42, left plate 46, and right plate 48). This allows image display device 10 to be manufactured more efficiently.

Moreover, in image display device 10 according to the present embodiment, power line 20 extends along the edge of display panel 12. Moreover, image display device 10 further includes inner frame 40 which is separated from outer frame 38 and which is disposed between power line 20 and the edge of display panel 12.

With this configuration, since inner frame 40 is disposed between the edge of display panel 12 and power line 20, it is possible to further prevent power line 20 from being seen by the user, and to prevent power line 20 from being broken due to contact between power line 20 and the edge of display panel 12. This leads to efficient manufacturing of image display device 10. Moreover, since inner frame 40 is separated from outer frame 38, inner frame 40 and power line 20 can be easily arranged before attaching outer frame 38. For example, in a state where display panel 12 is supported by upper plate 42, lower plate 44, and left plate 46, right molding portion 74 can be attached to the right edge of display panel 12 before attaching right plate 48, and then power line 20 can be disposed so as to extend along the right edge of display panel 12. In this way, right molding portion 74 and power line 20 can be arranged before attaching right plate 48. This facilitates work and arrangement of power line 20, leading to more efficient manufacturing of image display device 10.

Moreover, in image display device 10 according to the present embodiment, inner frame 40 includes grooves 82, 84, 98 and 100 for housing power line 20. Grooves 82, 98, 84, and 100 are recessed toward display panel 12, and are disposed along the edge of display panel 12.

With this configuration, by housing power line 20 in grooves 82, 98, 84, and 100, it is possible to further prevent power line 20 from being seen by the user. Moreover, by disposing power line 20 along grooves 82, 98, 84, and 100, power line 20 can be easily disposed so as to extend along the edge of display panel 12, leading to more efficient manufacturing of image display device 10.

Moreover, in image display device 10 according to the present embodiment, inner frame 40 includes front wall 78 and back wall 80, front wall 88 and back wall 90, and front wall 94 and back wall 96 which protrude toward display panel 12 and which are disposed so as to sandwich the edge of display panel 12 in the front and back direction.

With this configuration, by sandwiching display panel 12 between front wall 78 and back wall 80, upper molding portion 68 can be easily attached to the upper edge of display panel 12, leading to more efficient manufacturing of image display device 10. In a similar manner, by sandwiching display panel 12 between front wall 88 and back wall 90, lower molding portion 70 can be easily attached to the lower edge of display panel 12, and by sandwiching display panel 12 between front wall 94 and back wall 96, right molding portion 74 (left molding portion 72) can be easily attached to the right edge (left edge) of display panel 12.

Moreover, in image display device 10 according to the present embodiment, upper molding portion 68, lower molding portion 70, left molding portion 72, and right molding portion 74 are made of materials having flexibility greater than the flexibility of upper plate 42, lower plate 44, left plate 46, and right plate 48.

With this configuration, for example, even if the width of upper molding portion 68 is slightly greater than the width of first top groove 50 of upper plate 42, upper molding portion 68 can be easily housed in first top groove 50 of upper plate 42 by deforming upper molding portion 68. This allows image display device 10 to be manufactured more efficiently. The same also applies to other molding portions 70, 72, and 74.

Moreover, image display device 10 according to the present embodiment further includes conductive component 22 disposed on inner frame 40.

With this configuration, conductive component 22 can be housed in outer frame 38 together with inner frame 40, it is possible to prevent conductive component 22 from being seen by the user.

Moreover, image display device 10 according to the present embodiment further includes: illumination unit 16 which illuminates the region behind display panel 12; and power supply unit 18 which is electrically connected to illumination unit 16 via power line 20 and supplies power to illumination unit 16. Outer frame 38 includes: upper plate 42 which is disposed along the upper edge of display panel 12 and which supports illumination unit 16; and lower plate 44 which is disposed along the lower edge of display panel 12 and which supports power supply unit 18.

With this configuration, one or more objects 200 placed on lower plate 44 can be illuminated by the light emitted by illumination unit 16. Additionally, it is possible to prevent power line 20 connecting power supply unit 18 and illumination unit 16 from being seen by the user.

Embodiment 2

Hereinafter, Embodiment 2 will be described with reference to the drawings. In the following description, differences from image display device 10 according to Embodiment 1 will be mainly described.

[Configuration of Image Display Device]

Figure 11:
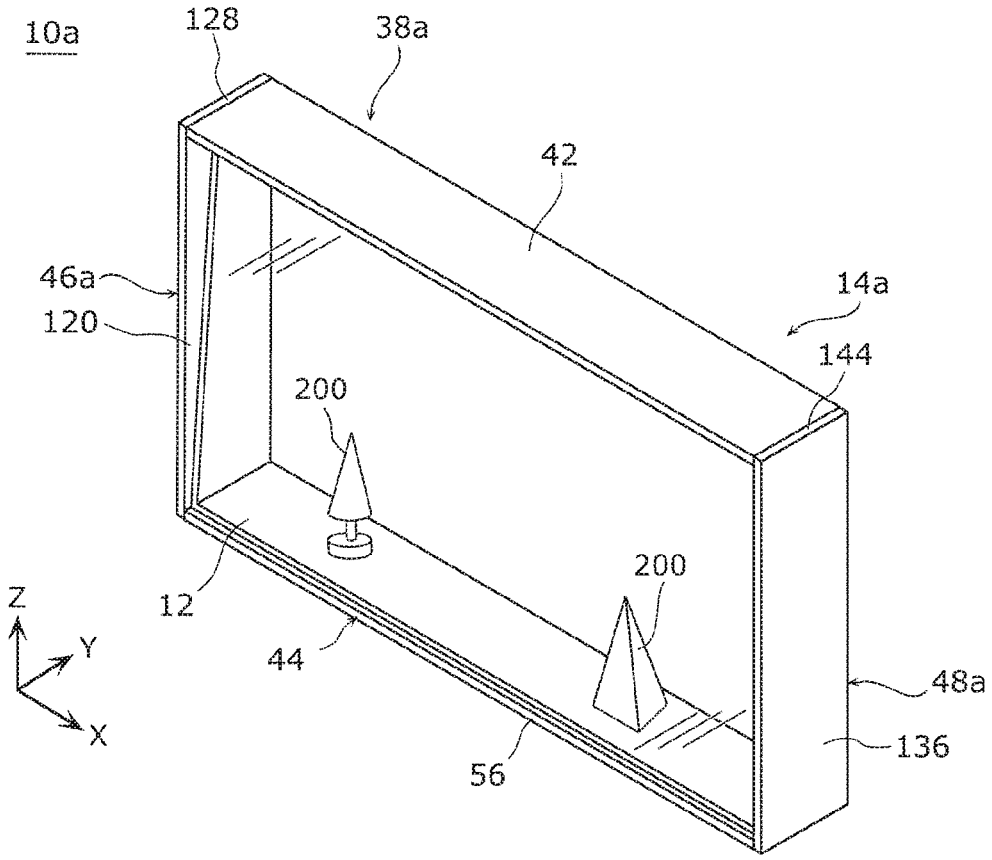
FIG. 11 is an external perspective view of a state of an image display device according to Embodiment 2 when operating in a first transmissive mode.

FIG. 11 is an external perspective view of image display device 10*a* according to Embodiment 2 when operating in a first transmissive mode. As illustrated in FIG. 11, image display device 10*a* according to the present embodiment is different from image display device 10 in that frame unit 14*a* is included instead of frame unit 14, Frame unit 14*a* is different from frame unit 14 in that outer frame 38*a* is included instead of outer frame 38. Outer frame 38*a* is different from outer frame 38 in that left plate 46*a* is included instead of left plate 46, and right plate 48*a* is included instead of right plate 48.

Left plate 46*a* is disposed along the left edge of display panel 12, and connects the left edge of upper plate 42 and the left edge of lower plate 44. Right plate 48*a* is disposed along the right edge of display panel 12, and connects the right edge of upper plate 42 and the right edge of lower plate 44. Each of left plate 46*a* and right plate 48*a* has a plate shape, and protrudes forward and rearward relative to display panel 12. Left plate 46*a* and right plate 48*a* are disposed in parallel to each other. Hereinafter, left plate 46*a* and right plate 48*a* will be described.

(Left Plate)

Figure 12:
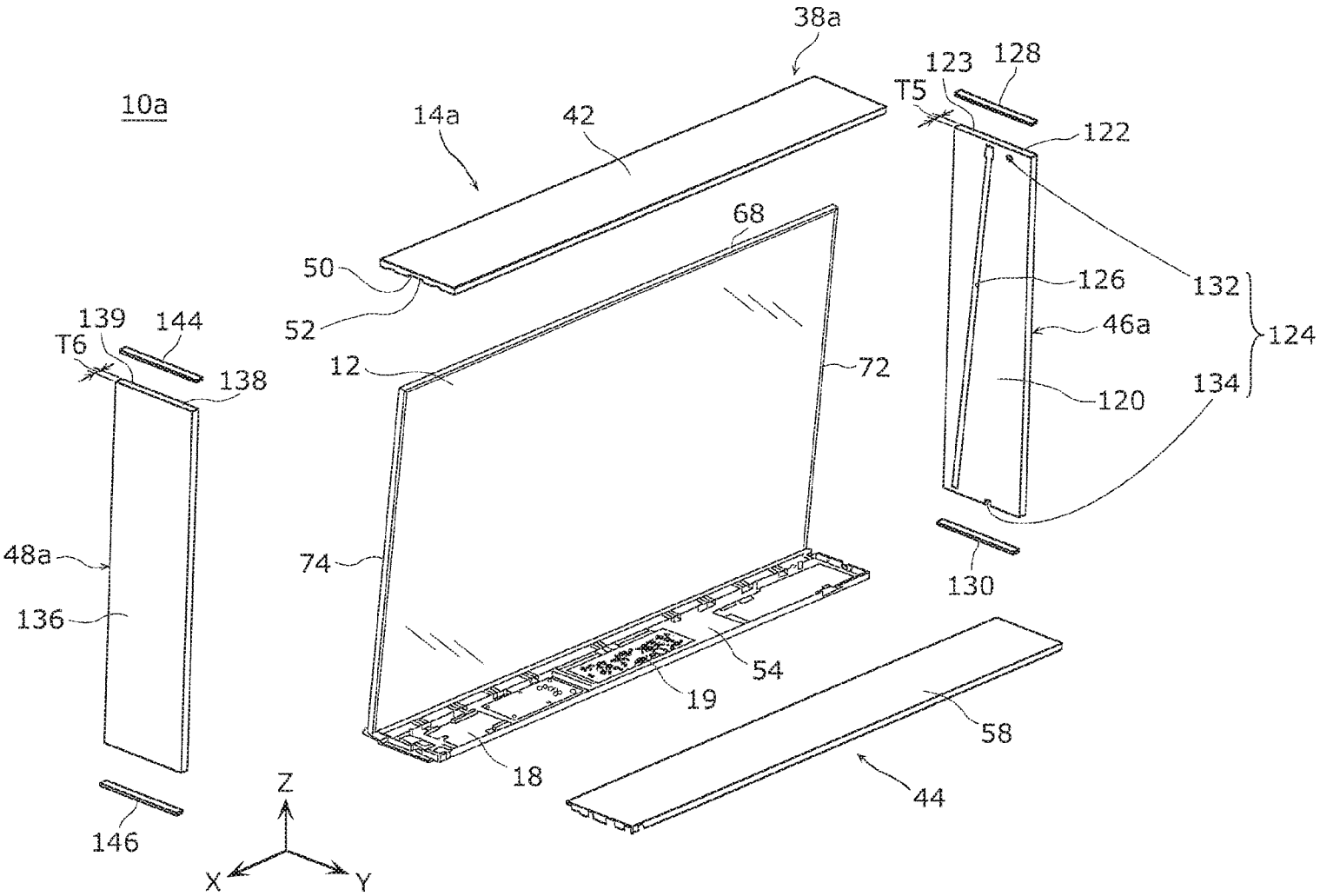
FIG. 12 is a rearward exploded perspective view of a state of the image display device according to Embodiment 2 when operating in the first transmissive mode.

FIG. 12 is a rearward exploded perspective view of a state of image display device 10*a* according to Embodiment 2 when operating in a first transmissive mode. As illustrated in FIG. 12, left plate 46*a* includes main body 120, first hollow portion 122, second hollow portion 123, communication hole 124, insertion hole 126, top lid 128, and bottom lid 130. First hollow portion 122 and second hollow portion 123 are formed within the thickness of main body 120. Specifically, first hollow portion 122 and second hollow portion 123 are positioned within thickness T5 (see FIG. 12) of main body 120 in the horizontal direction. Communication hole 124 is a hole which places first hollow portion 122 in communication with the back space behind display panel 12, and includes first hole 132 and second hole 134. Insertion hole 126 is in communication with second hollow portion 123, and is a portion into which display panel 12 is inserted. Since left plate 46*a* is symmetrically disposed relative to right plate 48*a*, the detailed description of left plate 46*a* will be omitted by referring to the description of right plate 48*a* to be described later.

(Right Plate)

Figure 13:
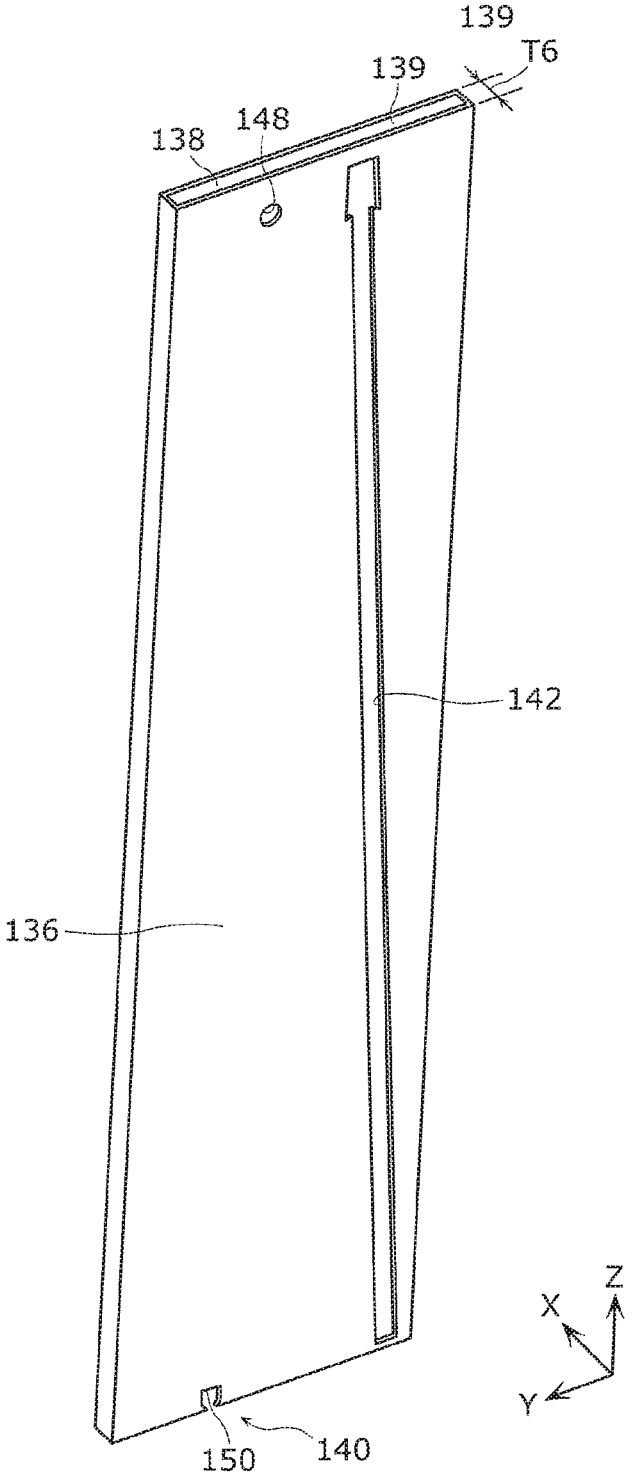
FIG. 13 is a perspective view of a main body of a right plate of the image display device according to Embodiment 2.
Figure 14:
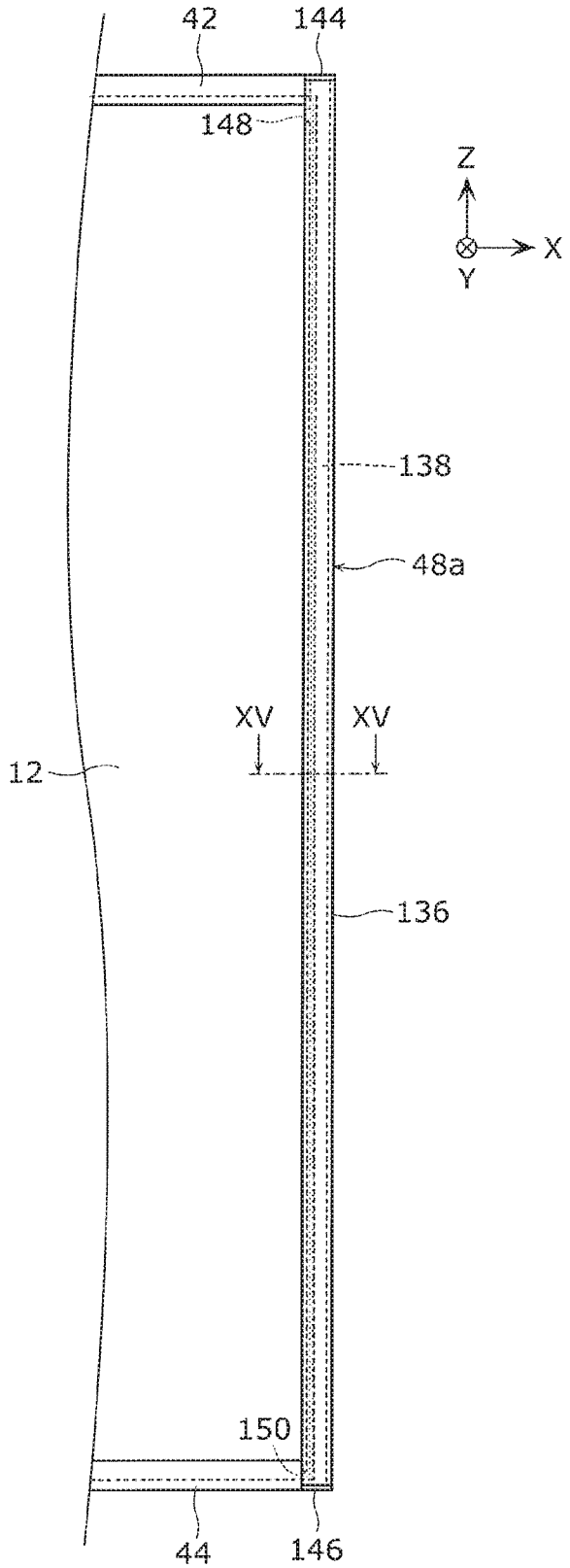
FIG. 14 is a front view of a portion in the vicinity of the right plate of the image display device according to Embodiment 2.
Figure 15:
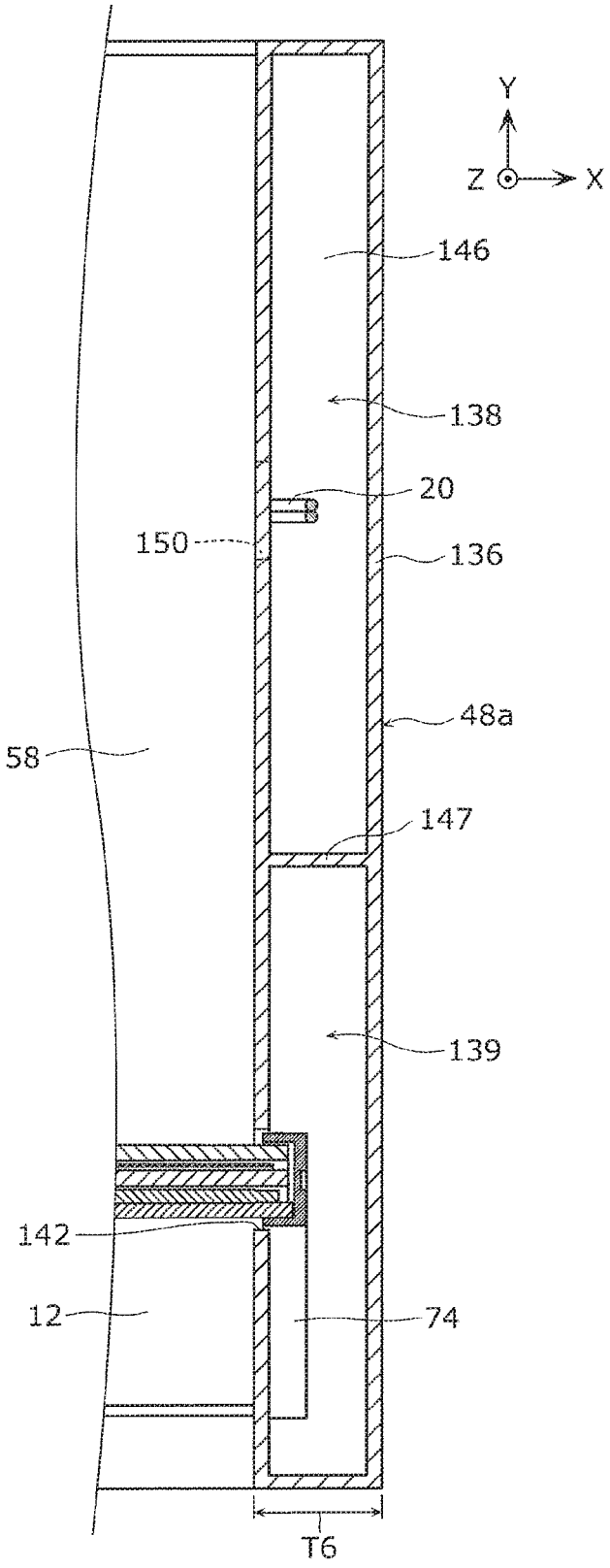
FIG. 15 is a cross-sectional view taken along line XV-XV in FIG. 14.

FIG. 13 is a perspective view of main body 136 of right plate 48*a* of image display device 10*a* according to Embodiment 2. FIG. 14 is a front view of a region in the vicinity of right plate 48*a* of image display device 10*a* according to Embodiment 2. FIG. 15 is a cross-sectional view taken along line XV-XV in FIG. 14.

As illustrated in FIG. 12 and FIG. 13, right plate 48*a* includes main body 136, first hollow portion 138, second hollow portion 139, communication hole 140, insertion hole 142, top lid 144, and bottom lid 146.

As illustrated in FIG. 13, main body 136 has a hollow plate shape, and display panel 12 is inserted to insertion hole 142. As illustrated in FIG. 14, main body 136 extends along the right edge of display panel 12 in the vertical direction. Moreover, as illustrated in FIG. 15, main body 136 protrudes forward and rearward relative to display panel 12. For example, main body 136 is made of a resin extruded material or a metal extruded material. Specifically, main body 136 is an extruded molded component formed by extruding and molding resin or metal. In the case where main body 136 is made of a metal extruded material, it is possible to prevent electrification of image display device 10*a*. Moreover, in the case where main body 136 is made of a resin extruded material or a metal extruded material, for example, an imitation wood sheet is pasted on the outer surface of right plate 48*a*. With this, for example, when image display device 10*a* is used in a room where wooden furniture or the like is placed, loss of interior aesthetic can be reduced. As described above, for example, right plate 48*a* is made of a resin extruded material or a metal extruded material.

As illustrated in FIG. 13, first hollow portion 138 is formed within the thickness of main body 136. Specifically, first hollow portion 138 is positioned within thickness T6 (see FIG. 12, FIG. 13, and FIG. 15) of main body 136 in the horizontal direction. First hollow portion 138 penetrates main body 136 in the vertical direction, and ranges from one end to the other end of main body 136. As illustrated in FIG. 14, in the front view of display panel 12, first hollow portion 138 extends along the right edge (see the dotted portion in FIG. 14) of display panel 12 in the vertical direction.

As illustrated in FIG. 15, in the top view of first hollow portion 138, first hollow portion 138 extends in the front and back direction, and is positioned rearward relative to display panel 12. Power line 20 is housed in the space within first hollow portion 138. Right plate 48*a* houses power line 20 within thickness T6 of right plate 48*a* (main body 136) by housing power line 20 in the space within first hollow portion 138. In this way, right plate 48*a* includes a first housing space for housing power line 20 within thickness T6 of right plate 48*a* (main body 136), The first housing space is a space within first hollow portion 138.

As illustrated in FIG. 13, second hollow portion 139 is formed within the thickness of main body 136. Specifically, second hollow portion 139 is positioned within thickness T6 (see FIG. 12, FIG. 13, and FIG. 15) of main body 136 in the horizontal direction. Second hollow portion 139 penetrates main body 136 in the vertical direction, and ranges from one end to the other end of main body 136. Second hollow portion 139 ranges from above the top end of insertion hole 142 to below the bottom end of insertion hole 142. Second hollow portion 139 is adjacent to first hollow portion 138, and the top end of second hollow portion 139 is in communication with the top end of first hollow portion 138.

As illustrated in FIG. 15, in the top view of second hollow portion 139, second hollow portion 139 extends in the front and back direction, and is positioned in front of first hollow portion 138. Inner wall 147 is disposed between second hollow portion 139 and first hollow portion 138. Inner wall 147 does not have to be disposed between second hollow portion 139 and first hollow portion 138. Second hollow portion 139 and first hollow portion 138 may be integrally formed. The right edge of display panel 12 and right molding portion 74 attached to the right edge of display panel 12 are housed in the space within second hollow portion 139. Specifically, in the space within second hollow portion 139, the top end to the bottom end of the right edge of display panel 12 is housed, and the top end to the bottom end of right molding portion 74 attached to the right edge of display panel 12 is housed. Right plate 48*a* houses the right edge of display panel 12 and right molding portion 74 attached to the right edge of display panel 12 within thickness T6 of right plate 48*a* (main body 136), by housing the right edge of display panel 12 and right molding portion 74 attached to the right edge of display panel 12 in the space within second hollow portion 139. In this way, right plate 48*a* includes a second housing space for housing the right edge of display panel 12 within thickness T6 of right plate 48*a* (main body 136). The second housing space is a space within second hollow portion 139.

As illustrated in FIG. 13, communication hole 140 is a hole which places first hollow portion 138 in communication with the back space behind display panel 12, and includes first hole 148 and second hole 150. The back space behind display panel 12 is a space positioned behind display panel 12. For example, the back space is a space behind display panel 12 and is surrounded by upper plate 42, bottom plate 54 of lower plate 44, left plate 46*a*, and right plate 48*a* (see S in FIG. 16 and FIG. 17).

First hole 148 is disposed on the top end portion of main body 136 and behind insertion hole 142 into which display panel 12 is inserted, that is, behind display panel 12. First hole 148 is a through hole which is in communication with first hollow portion 138, and penetrates the left-side surface of main body 136. As illustrated in FIG. 14, in the front view of display panel 12, first hole 148 places one end (top end) of first hollow portion 138 in communication with one end (top end) of the back space in the extension direction (vertical direction) of first hollow portion 138. In the front view of display panel 12, first hole 148 is connected to one end (top end) of first hollow portion 138 and one end (top end) of the back space in the extension direction (vertical direction) of first hollow portion 138.

As illustrated in FIG. 13, second hole 150 is disposed on the bottom end of main body 136 and behind insertion hole 142 into which display panel 12 is inserted, that is, behind display panel 12. Second hole 150 is a through hole which is in communication with first hollow portion 138, and which cuts out the left-side surface of main body 136. As illustrated in FIG. 14, in the extension direction (vertical direction) of first hollow portion 138 in the front view of display panel 12, second hole 150 places the other end (bottom end) of first hollow portion 138 in communication with the other end (bottom end) of the back space. Second hole 150 is connected to the other end (bottom end) of first hollow portion 138 and the other end (bottom end) of the back space in the extension direction (vertical direction) of first hollow portion 138 in the front view of display panel 12.

As illustrated in FIG. 13, insertion hole 142 is disposed in front of first hole 148 and second hole 150, and extends diagonally in the vertical direction. Insertion hole 142 is a through hole which is in communication with second hollow portion 139, and penetrates the left-side surface of main body 136. As illustrated in FIG. 15, display panel 12 is inserted into insertion hole 142. Second hollow portion 139 houses the edge of display panel 12 and right molding portion 74 attached to the right edge of display panel 12.

As illustrated in FIG. 12, top lid 144 is disposed on the upper edge of main body 136 so as to cover first hollow portion 138 and second hollow portion 139 from above. For example, bolt holes are disposed within the thickness of main body 136, and top lid 144 is attached to main body 136 using bolts.

Bottom lid 146 is attached to the lower edge of main body 136 so as to block first hollow portion 138 and second hollow portion 139 from below. For example, bolt holes are disposed within the thickness of main body 136, and bottom lid 146 is attached to main body 136 using bolts.

(Power Line)

Figure 16:
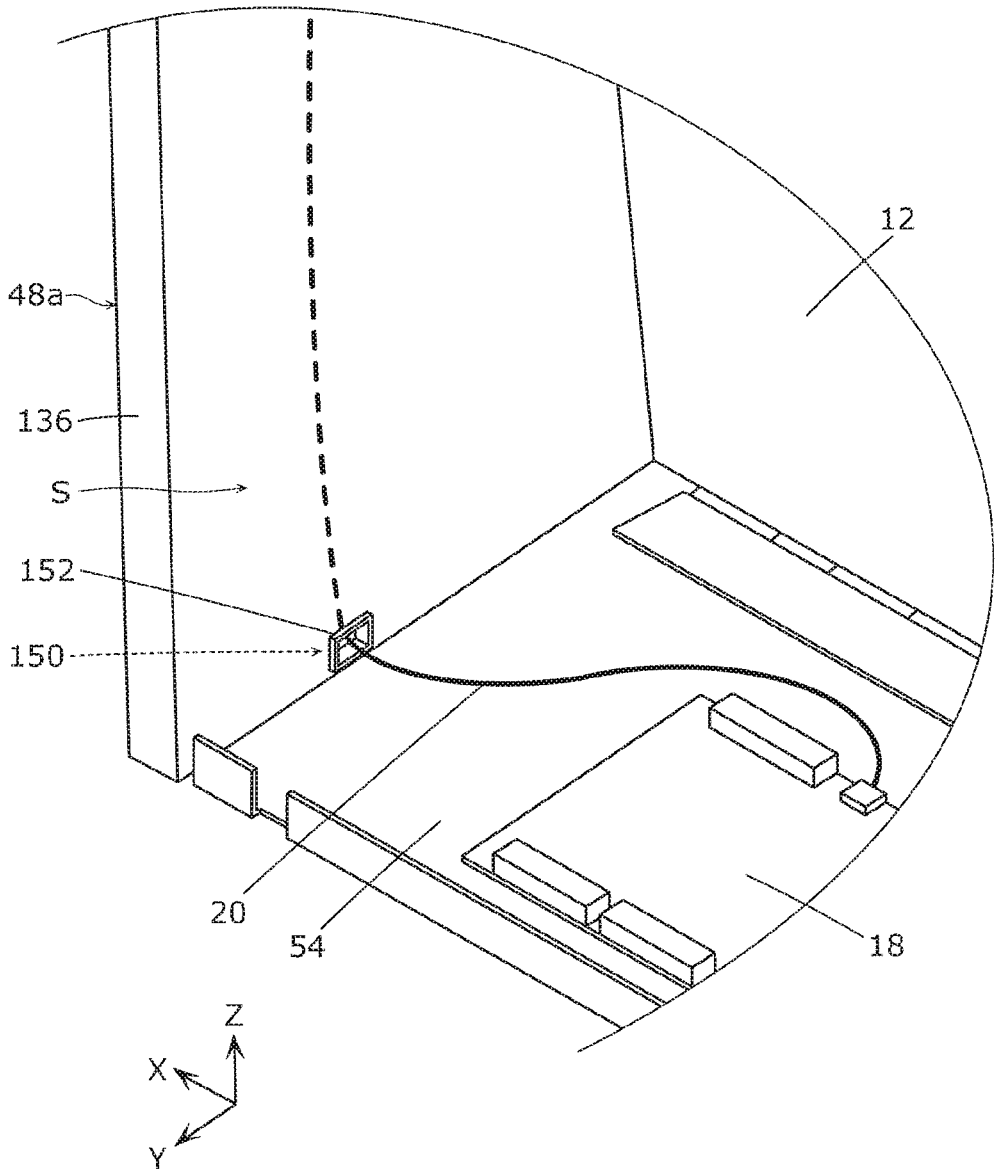
FIG. 16 is an enlarged view of a portion in the vicinity of a second hole.
Figure 17:
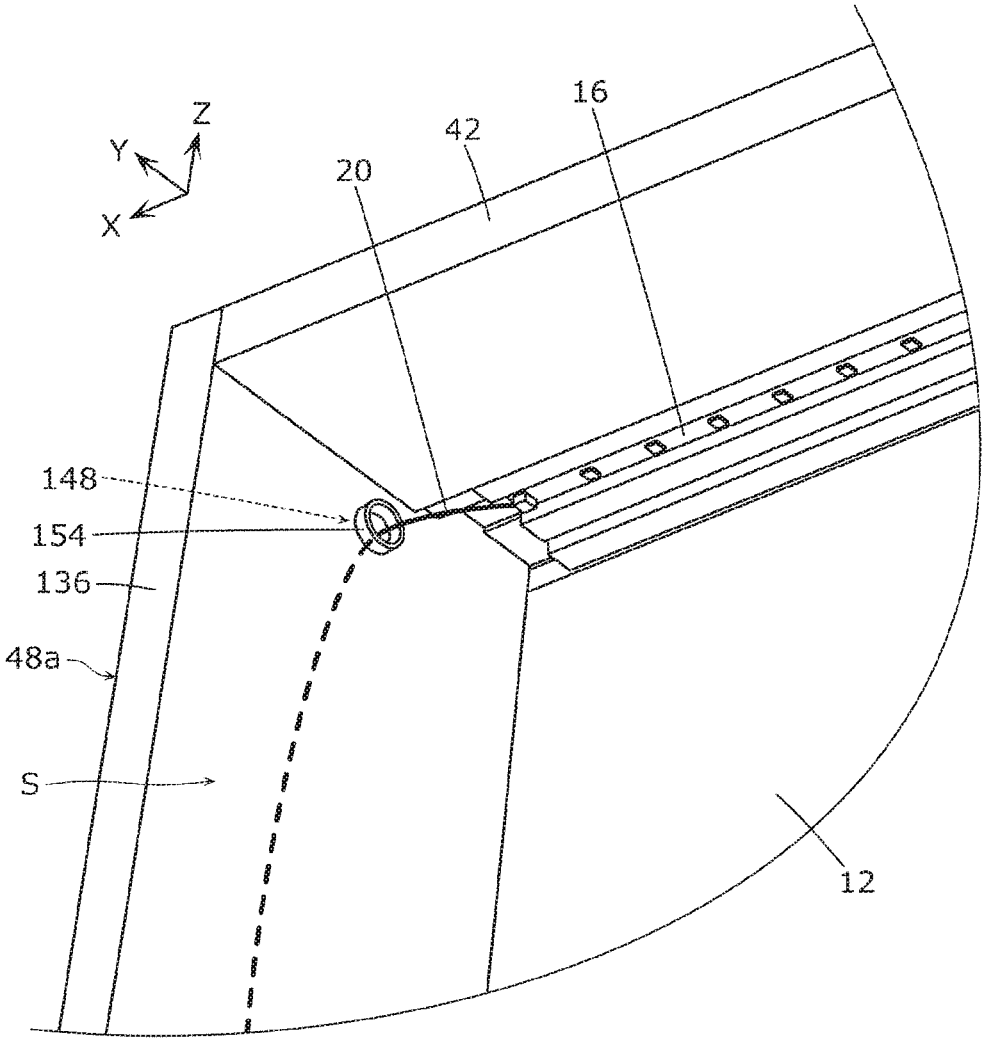
FIG. 17 is an enlarged view of a portion in the vicinity of a first hole.

FIG. 16 is an enlarged view of a portion in the vicinity of second hole 150. FIG. 17 is an enlarged view of a portion in the vicinity of first hole 148. With reference to FIG. 15 to FIG. 17, in the present embodiment, power line 20 is a power line which electrically connects illumination unit 16 and power supply unit 18. Power line 20 is disposed along the periphery of display panel 12. Power line 20 connected to power supply unit 18 in lower plate 44 is, for example, housed in first hollow portion 138, extends upward, and is connected to illumination unit 16. Specifically, with reference to FIG. 16, power line 20 connected to power supply unit 18 in back space S is inserted into second hole 150, and is led to first hollow portion 138. As illustrated in FIG. 15, power line 20 is led upward within first hollow portion 138. Here, resin protector 152 is attached to second hole 150. This prevents power line 20 from being broken by contacting second hole 150. With reference to FIG. 17, power line 20 is inserted to first hole 148, is lead to back space S behind display panel 12, and is connected to illumination unit 16. Here, resin protector 154 is attached to first hole 148. This prevents power line 20 from being broken by contacting first hole 148. In this way, power line 20 is housed in the space within first hollow portion 138, and extends upward, so that power supply unit 18 and illumination unit 16 are electrically connected. The wiring route of power line 20 is not limited to such an example. For example, power line 20 may be housed in the space within first hollow portion 122 of left plate 46*a* and extends upward. It may also be that the upper plate includes a hollow portion within the thickness of the upper plate, so that power line 20 is housed in the space within the hollow portion of the upper plate. In this case, the upper plate may be made of a resin extruded material or a metal extruded material. It may also be that the lower plate includes a hollow portion within the thickness of the lower plate, so that power line 20 is housed in the space within the hollow portion of the lower plate. In this case, the lower plate may be made of a resin extruded material or a metal extruded material. Moreover, the number of power lines housed in first housing portion 138 may be one or plural. The cross-sectional shape of the power line is not limited to a circular shape, but may be a square shape or the like. For power line 20, for example, a power line is used in which a conductor, such as a copper line, is covered by an insulator.

Advantageous Effects, Etc.

As described above, in image display device 10*a* according to the present embodiment, outer frame 38*a* includes a first hollow portion (first hollow portion 122 and first hollow portion 138) within the thickness of outer frame 38*a* (left plate 46*a* and right plate 48*a*). The first housing space is a space within the first hollow portion (first hollow portion 122 and first hollow portion 138).

With this configuration, the first housing space for housing power line 20 is a space within the first hollow portion (first hollow portion 122 and first hollow portion 138) within the thickness of outer frame 38*a* (left plate 46*a* and right plate 48*a*). Accordingly, by housing power line 20 in the space within the first hollow portion (first hollow portion 122 and first hollow portion 138), power line 20 can be easily housed within the thickness of outer frame 38*a* (left plate 46*a* and right plate 48*a*), leading to efficient manufacturing of image display device 10*a*.

Moreover, in image display device 10*a* according to the present embodiment, outer frame 36*a* (left plate 46*a* and right plate 48*a*) further includes a communication hole (communication hole 124 and communication hole 140) which places the first hollow portion (first hollow portion 122 and first hollow portion 138) in communication with the back space behind display panel 12.

With this configuration, power line 20 connected to illumination unit 16 and the like disposed in the back space behind display panel 12 can be easily housed in the space within the first hollow portion (first hollow portion 122 and first hollow portion 138) via the communication hole (communication hole 124 and communication hole 140). Hence, image display device 10*a* can be manufactured more efficiently.

Moreover, in image display device 10*a* according to the present embodiment, in the front view of display panel 12, the first hollow portion (first hollow portion 122 and first hollow portion 138) extends along the edge of display panel 12. The communication hole (communication hole 124 and communication hole 140) includes a first hole (first hole 132 and first hole 148) and a second hole (second hole 134 and second hole 150). The first hole places one end of the first hollow portion (first hollow portion 122 and first hollow portion 138) in the extension direction in the front view of display panel 12 in communication with the back space. The second hole places the other end of first hollow portion (first hollow portion 122 and first hollow portion 138) in the extension direction in the front view of display panel 12 in communication with the back space.

With this configuration, illumination unit 16 disposed in the vicinity of one end of the first hollow portion (first hollow portion 122 and first hollow portion 138) in the extension direction in the front view of display panel 12 and power line 20 housed in the space within the first hollow portion (first hollow portion 122 and first hollow portion 138) can be easily connected to each other via the first hole (first hole 132 and first hole 148). Moreover, power supply unit 18 disposed in the vicinity of the other end of the first hollow portion (first hollow portion 122 and first hollow portion 138) in the extension direction in the front view of display panel 12 and power line 20 housed in the space within the first hollow portion (first hollow portion 122 and first hollow portion 138) can be easily connected to each other via the second hole (second hole 134 and second hole 150). Hence, image display device 10*a* can be manufactured more efficiently.

Moreover, in image display device 10*a* according to the present embodiment, outer frame 38*a* (left plate 46*a* and right plate 48*a*) further includes a second hollow portion (second hollow portion 123 and second hollow portion 139) within the thickness of outer frame 38*a* (left plate 46*a* and right plate 48*a*) and an insertion hole (insertion hole 126 and insertion hole 142) which is in communication with the second hollow portion (second hollow portion 123 and second hollow portion 139) and into which display panel 12 is inserted. The second housing space is a space within the second hollow portion (second hollow portion 123 and second hollow portion 139).

With this configuration, by inserting display panel 12 into the insertion hole (insertion hole 126 and insertion hole 142), the edge of display panel 12 can be easily housed in the space (second housing space) within the second hollow portion (second hollow portion 123 and second hollow portion 139). Hence, image display device 10*a* can be manufactured more efficiently.

Moreover, in image display device 10*a* according to the present embodiment, outer frame 38*a* (left plate 46*a* and right plate 48*a*) is made of a resin extruded material or a metal extruded material.

With this configuration, since an increase in cost at the time of mass production of outer frame 38*a* (left plate 46*a* and right plate 48*a*) can be reduced, an increase in cost at the time of mass production of image display device 10*a* can be reduced.

Other Embodiments, Etc.

As described above, embodiments have been described as examples of the technique disclosed in the present application. However, the technique according to the present disclosure is not limited to these examples, and is also applicable to embodiments to which various kinds of modifications, replacements, additions, omissions have appropriately been made. Moreover, each structural element described in the above embodiments may be combined to obtain a new embodiment. Another embodiment will be described below as an example.

Figure 18:
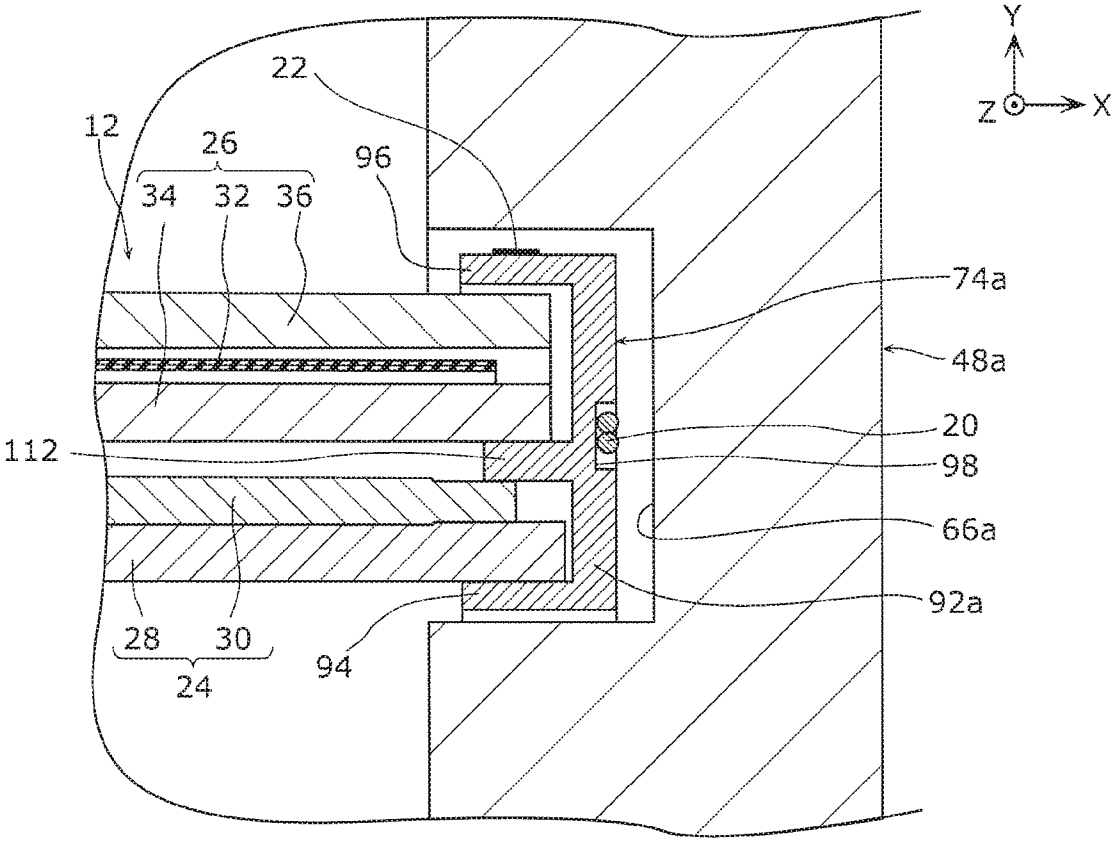
FIG. 18 is a cross-sectional view of an image display device according to another embodiment.

For example, as illustrated in FIG. 18, the left molding portion and right molding portion 74*a* may include middle wall 112. Middle wall 112 protrudes toward display panel 12 from the vicinity of the central portion of main body 92*a* in the width-wise direction of main body 92*a*. By disposing display panel 12 such that organic EL panel 24 and light control panel 26 which are stacked in the front and back direction sandwich middle wall 112, organic EL panel 24 and light control panel 26 can be disposed to be spaced apart from each other. Accordingly, heat from organic EL panel 24 and light control panel 26 can be released efficiently. Right molding portion 74*a* is housed in right groove 66*a*. The upper molding portion and the lower molding portion may include a middle wall. In the present embodiment, organic EL panel 24 and light control panel 26 correspond to two panels.

Moreover, for example, image display device 10 or image display device 10*a* according to the present embodiment may be applied to furniture. Specifically, loss of interior aesthetic can be prevented by integrally forming furniture, such as a shelf, used in a house and image display device 10 or image display device 10*a*.

Figure 19:
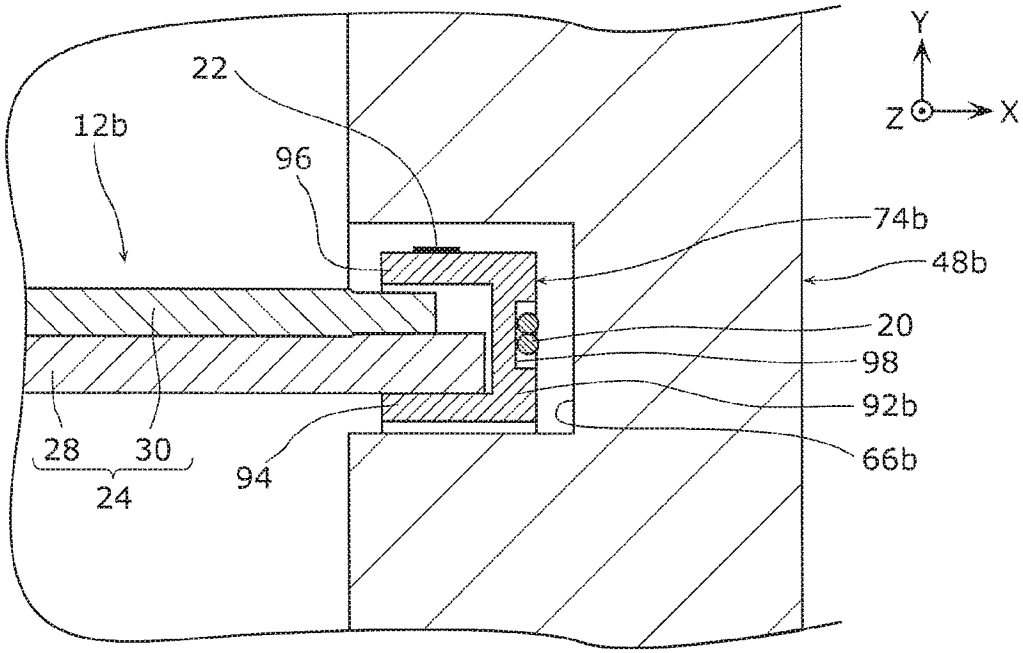
FIG. 19 is a cross-sectional view of an image display device according to another embodiment.

In the embodiments described above, the case has been described where display panel 12 includes light control panel 26, but the present disclosure is not limited to such an example. For example, display panel 12*b* does not have to include a light control panel (see FIG. 19). In this case, for example, right molding portion 74*b* is used which includes main body 92*b* which is smaller in size in the width-wise direction than main body 92, and right molding portion 74*b* is housed in right groove 66*b* of right plate 48*b*.

In Embodiment 1 described above, the case has been described where plate shaped outer frame 38 (upper plate 42, lower plate 44, left plate 46, and right plate 48) is disposed along the edge of display panel 12, but the present disclosure is not limited to such an example. For example, an outer frame having a prism shape or the like may be disposed along the edge of display panel 12.

In Embodiment 2 described above, the case has been described where plate shaped outer frame 38*a* (upper plate 42, lower plate 44, left plate 46*a*, and right plate 48*a*) is disposed along the edge of display panel 12, but the present disclosure is not limited to such an example. For example, an outer frame having a prism shape or the like may be disposed along the edge of display panel 12.

In Embodiment 1 described above, the case has been described where outer frame 38 includes upper plate 42, lower plate 44, left plate 46, and right plate 48, but the present disclosure is not limited to such an example. For example, in the case where power line 20 does not extend along the left edge of display panel 12, outer frame 38 does not have to include left plate 46. The same also applies to upper plate 42, lower plate 44, and right plate 48.

In Embodiment 2 described above, the case has been described where outer frame 38*a* includes upper plate 42, lower plate 44, left plate 46*a*, and right plate 48*a*, but the present disclosure is not limited to such an example. For example, in the case where power line 20 is not housed within the thickness of left plate 46*a*, outer frame 38*a* does not have to include left plate 46*a*. The same also applies to upper plate 42, lower plate 44, and right plate 48*a*.

In Embodiment 1 descried above, the case has been described where inner frame 40 includes upper molding portion 68, lower molding portion 70, left molding portion 72, and right molding portion 74, but the present disclosure is not limited to such an example. For example, in the case where power line 20 does not extend along the left edge of display panel 12, inner frame 40 does not have to include left molding portion 72. The same also applies to upper molding portion 68, lower molding portion 70, and right molding portion 74.

In Embodiment 2 described above, the case has been described where frame unit 14*a* includes inner frame 40, but the present disclosure is not limited to such an example. For example, frame unit 14*a* does not have to include inner frame 40.

In the embodiments described above, the case has been described where power line 20 does not extend along the lower edge of display panel 12, but the present disclosure is not limited to such an example. For example, it may be that a groove is disposed on a main surface of main body 86 of lower molding portion 70 opposite to the other main surface of main body 86 adjacent to the bottom end surface of display panel 12, and power line 20 extends along the lower edge of display panel 12 by housing power line 20 in the groove.

In Embodiment 1 described above, the case has been described where power line 20 extends along the end surface of display panel 12, but the present disclosure is not limited to such an example. For example, power line 20 may extend, on the edge of display panel 12, along the front surface of display panel 12 or back surface of display panel 12.

In the embodiments described above, the case has been described where grooves 82 and 84 are disposed in main body 76 of upper molding portion 68, but the present disclosure is not limited to such an example. For example, a groove for housing power line 20 may be disposed on the front surface of front wall 78 of upper molding portion 68, or may be disposed on the back surface of back wall 80. The same also applies to lower molding portion 70, left molding portion 72, and right molding portion 74.

In the embodiments described above, the case has been described where upper molding portion 68 includes front wall 78, back wall 80, and grooves 82 and 84, but the present disclosure is not limited to such an example. For example, upper molding portion 68 does not have to include front wall 78, back wall 80, and groove 82. The same also applies to lower molding portion 70, left molding portion 72, and right molding portion 74.

In the embodiments described above, the case has been described where power line 20 electrically connects illumination unit 16 and power supply unit 18, but the present disclosure is not limited to such an example. For example, it may be that a loudspeaker and/or a wireless module or the like is disposed in upper plate 42, and power line 20 electrically connects the loudspeaker and/or the wireless module and power supply unit 18.

In the embodiments described above, the case has been described where power supply unit 18 is housed inside lower plate 44, but the present disclosure is not limited to such an example. For example, the power supply unit does not have to be housed inside lower plate 44, but may be disposed outside lower plate 44. In this case, for example, the power supply unit may be housed in a power supply box or the like. Moreover, for example, the power supply unit may be disposed within first hollow portion 122, second hollow portion 123, first hollow portion 138, or second hollow portion 139.

In the embodiments described above, the case has been described where light control panel 26 includes first glass plate 34 disposed in front of light control sheet 32 and second glass plate 36 disposed behind light control sheet 32, but the present disclosure is not limited to such an example. For example, it may be that the light control panel includes, instead of first glass plate 34 and second glass plate 36, a first resin plate disposed in front of the light control sheet and a second resin plate disposed behind the light control sheet.

In the embodiments described above, the case has been described where outer frames 38 and 38*a* support display panel 12 such that display panel 12 tilts slightly rearward, but the present disclosure is not limited to such an example. For example, the outer frame may support display panel 12 such that display panel 12 does not tilt in the front and back direction.

In Embodiment 1 described above, the case has been described where left groove 64 and right groove 66 extend diagonally in the vertical direction, but the present disclosure is not limited to such an example. For example, the left groove and the right groove may extend in parallel to each other in the vertical direction, instead of extending diagonally in the vertical direction.

In Embodiment 2 described above, the case has been described where insertion hole 126 and insertion hole 142 extend diagonally in the vertical direction, but the present disclosure is not limited to such an example. For example, the insertion holes may extend in parallel to each other in the vertical direction, instead of extending diagonally in the vertical direction.

As described above, embodiments have been described as examples of the technique disclosed in the present disclosure. For this purpose, the accompanying drawings and detailed description are provided.

Accordingly, the structural elements described in the accompanying drawings and detailed description may include not only structural elements which are essential for solving the problem but also structural elements which are not essential for solving the problem but are provided for illustrating the technique. Therefore, the non-essential structural elements described in the attached drawings and/or the detailed description should not be instantly acknowledged to be essential structural elements.

Since the above embodiments are intended to illustrate the technique in the present disclosure, it is possible to make various kinds of modifications, replacements, additions, omissions, and the like within the scope of the claims or an equivalent scope thereof.

INDUSTRIAL APPLICABILITY

The present disclosure is applicable to an image display device, such as a television receiver, a monitor display, or a digital signage.

The invention claimed is:

1. An image display device, comprising:

a display panel switchable between an image display mode and a transmissive mode, the image display mode being a mode in which an image is displayed, the transmissive mode being a mode in which the display panel is in a transmissive state where an object behind the display panel is visible in a front view of the display panel;

a power line disposed along a periphery of the display panel; and an outer frame disposed along an edge of the display panel, the outer frame including a first housing space for housing the power line and a second housing space for housing the edge of the display panel, wherein the outer frame includes a first hollow portion within a thickness of the outer frame, the first housing space is a space within the first hollow portion, the outer frame further includes a communication hole which places the first hollow portion in communication with a back space behind the display panel, the first hollow portion extends along the edge of the display panel in the front view of the display panel, and the communication hole includes a first hole and a second hole, the first hole placing a first end of the first hollow portion in communication with the back space, the second hole placing a second end of the first hollow portion in communication with the back space, the first end and the second end being ends of the first hollow portion in an extension direction of the first hollow portion in the front view of the display panel.

2. The image display device according to claim 1, wherein the outer frame includes: a second hollow portion within a thickness of the outer frame; and an insertion hole which is in communication with the second hollow portion and into which the display panel is inserted, and the second housing space is a space within the second hollow portion.

3. The image display device according to claim 1, wherein the outer frame is made of one of a resin extruded material and a metal extruded material.

4. The image display device according to claim 1, further comprising:

an illumination unit which illuminates a region behind the display panel; and a power supply unit which is electrically connected to the illumination unit via the power line and supplies power to the illumination unit, wherein the outer frame includes an upper outer frame and a lower outer frame, the upper outer frame being disposed along an upper edge of the display panel and supporting the illumination unit, the lower outer frame being disposed along a lower edge of the display panel and supporting the power supply unit.

5. A furniture, comprising:

the image display device according to claim 1.

6. An image display device, comprising:

a display panel switchable between an image display mode and a transmissive mode, the image display mode being a mode in which an image is displayed, the transmissive mode being a mode in which the display panel is in a transmissive state where an object behind the display panel is visible in a front view of the display panel;

a power line disposed along a periphery of the display panel; and an outer frame disposed along an edge of the display panel, the outer frame including a first housing space for housing the power line and a second housing space for housing the edge of the display panel, wherein the power line extends along the edge of the display panel, and the image display device further comprises:

an inner frame disposed between the power line and the edge of the display panel, the inner frame being separated from the outer frame.

7. The image display device according to claim 6, wherein the outer frame includes an outer frame groove within a thickness of the outer frame, and the first housing space and the second housing space are spaces within the outer frame groove.

8. The image display device according to claim 6, wherein the inner frame includes an inner frame groove for housing the power line, the inner frame groove being recessed toward the display panel and disposed along the edge of the display panel.

9. The image display device according to claim 6, wherein the inner frame includes a pair of walls protruding toward the display panel, the pair of walls sandwiching the edge of the display panel in a front and back direction of the image display device.

10. The image display device according to claim 6, wherein the display panel includes two panels which are stacked, and the inner frame includes a middle wall protruding toward the display panel, the middle wall being sandwiched between the two panels in a stacking direction of the two panels.

11. The image display device according to claim 6, wherein the inner frame is made of a material having a flexibility greater than a flexibility of the outer frame.

12. The image display device according to claim 6, further comprises:

a conductive component disposed on the inner frame.

13. An image display device, comprising:

a display panel switchable between an image display mode and a transmissive mode, the image display mode being a mode in which an image is displayed, the transmissive mode being a mode in which the display panel is in a transmissive state where an object behind the display panel is visible in a front view of the display panel;

a power line disposed along a periphery of the display panel; and an outer frame disposed along an edge of the display panel, the outer frame including a first housing space for housing the power line and a second housing space for housing the edge of the display panel, wherein the outer frame includes a first hollow portion within a thickness of the outer frame and a second hollow portion within the thickness of the outer frame, the first housing space is a space within the first hollow portion, the second housing space is a space within the second hollow portion, and the second hollow portion is positioned in front of the first hollow portion.

14. The image display device according to claim 13, wherein an inner wall is disposed between the second hollow portion and the first hollow portion.

* * * * *